US006800427B2

(12) United States Patent
Yamane

(10) Patent No.: US 6,800,427 B2
(45) Date of Patent: Oct. 5, 2004

(54) HEAT-DEVELOPABLE PHOTOSENSITIVE MATERIAL AND METHOD OF PROCESSING THE SAME

(75) Inventor: Katsutoshi Yamane, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 10/452,053

(22) Filed: Jun. 3, 2003

(65) Prior Publication Data

US 2004/0002021 A1 Jan. 1, 2004

(30) Foreign Application Priority Data

Jun. 4, 2002 (JP) ..... P.2002-162897

(51) Int. Cl.[7] ..... G03C 5/16

(52) U.S. Cl. ..... 430/350; 430/523; 430/527; 430/619; 430/631

(58) Field of Search ..... 430/631, 527, 430/619, 523, 350; 396/575

(56) References Cited

U.S. PATENT DOCUMENTS

| | | | | | |
|---|---|---|---|---|---|
| 4,968,599 | A | * | 11/1990 | Pitt et al. | 430/631 |
| 5,698,380 | A | * | 12/1997 | Toya | 430/617 |
| 6,203,972 | B1 | * | 3/2001 | Katoh et al. | 430/619 |
| 6,335,153 | B1 | * | 1/2002 | Toya | 430/350 |
| 6,589,723 | B2 | * | 7/2003 | Yamanouchi et al. | 430/529 |

* cited by examiner

*Primary Examiner*—Thorl Chea
(74) *Attorney, Agent, or Firm*—Sughrue Mion, PLLC

(57) ABSTRACT

A heat-developable photosensitive material, which comprises a light-sensitive layer containing a light-sensitive silver halide, a light-insensitive organic silver salt, a thermal developer and a binder and a protective layer containing a fluorine compound having at least one fluorinated alkyl group having not less than 2 carbon atoms and not more than 13 fluorine atoms and at least one anionic or nonionic hydrophilic group, and is subjected to processing by a heat-developing machine having a stock tray for heat-developable photosensitive materials placed at the height of not more than 55 cm above the floor.

7 Claims, 2 Drawing Sheets

HEAT-DEVELOPABLE PHOTOSENSITIVE MATERIAL AND METHOD OF PROCESSING THE SAME

FIELD OF THE INVENTION

The present invention relates to a heat-developable photosensitive material and a method of processing the same.

BACKGROUND OF THE INVENTION

In recent years, reduction in wastes of processing solutions for photographic materials has been strongly desired from the viewpoints of environmental conservation and space saving in the medical field. Therefore, new technologies regarding light-sensitive heat-developable photographic materials used for medical diagnosis and photographic technology, which can be efficiently exposed by means of a laser image setter or a laser imager and form clear black images having high resolution and high sharpness, have been desired. It is possible for such light-sensitive heat-developable photographic materials to eliminate the necessity of using solutions of processing chemicals and to supply simpler and environmentally friendly heat-developable processing systems for customers Although such requirements are also present in the field of common image-forming materials, images for medical use are required to have high qualities including excellent sharpness and graininess, because fine depiction is essential to them. Also, they have a feature that it is desirable to have a cold black tone from a viewpoint of ease of diagnosis. At present, various kinds of hard copy systems utilizing pigment or dye, for example, inkjet printers and electrophotography, are distributed as common image-forming systems, but they are not satisfactory as output systems of images for medical use.

On the other hand, thermal image formation systems utilizing organic silver salts are described, e.g., in U.S. Pat. Nos. 3,152,904 and 3,457,075, and B. Shely, Thermally Processed Silver Systems in *Imaging Processes and Materials*, Neblette's 8th Edition, compiled by Sturge, V. Walworth and A, Shepp, page 2 (1996). In particular, a heat-developable photosensitive material ordinarily has a light-sensitive layer containing a binder matrix dispersed therein a catalytic amount of photocatalyst (e.g., silver halide), a reducing agent, a reducible silver salt (e.g., an organic silver salt) and, if desired, a toning agent for controlling color tone of silver. After imagewise exposure, the heat-developable photosensitive material is heated at a high temperature (e.g., 80° C. or higher) to cause a redox reaction between the silver halide or reducible silver salt (acting as an oxidizing agent) and the reducing agent, thereby forming a black silver image. The redox reaction is accelerated by the catalytic action of a latent image of the silver halide formed upon the image exposure. Thus, the black silver image is formed in the exposed area. The heat-developable photosensitive materials are described in many documents including U.S. Pat. No. 2,910,377 and JP-B-43-4924 (the term "JP-B" as used herein means an "examined Japanese patent publication"). Also, Fuji Medical Dry Imager FM-DP L is available as a medical image formation system utilizing heat-developable photosensitive materials.

Such an imager for processing heat-developable photosensitive materials has a tray to stock unexposed photosensitive materials. On the ground of stocking various sizes of photosensitive materials or for the purpose of reducing the trouble of replacement of photosensitive materials, imagers having two trays have been developed and are launched on the market by various manufacturers. However, to further increase the number of trays is the requirement of the market. In order to increase the number of trays, it is inevitable to place a tray for photosensitive materials in the position closer to the floor as compared with conventional machines. Thus, the desired number of trays is ensured while keeping the total height of machine. However, the placing of a tray for photosensitive materials in the position closer to the floor causes an inherent trouble due to dust. Since the density of naturally occurring dust increases with coming close to the floor, the dust gets into the tray for photosensitive materials with opening and closing of the tray. Therefore, it has been desired to solve problems, for example, white spots on images and unevenness of density, which occur at exposure to light and heat-development of the photosensitive materials.

SUMMARY OF THE INVENTION

Therefore, an object of the invention is to provide a heat-developable photosensitive material having surface characteristics of-effectively preventing from adhesion of dust, which is inherently present in large amounts in the area close to the floor.

Another object of the invention is to provide a method of processing such a heat-developable photosensitive material.

Other objects of the invention will become apparent from the following description.

The objects of the invention can be accomplished by a heat-developable photosensitive material and a method of processing the same as described below.

(1) A heat-developable photosensitive material, which comprises a light-sensitive layer containing a light-sensitive silver halide, a light-insensitive organic silver salt, a thermal developer and a binder and a protective layer containing a fluorine compound having at least one fluorinated alkyl group having not less than 2 carbon atoms and not more than 13 fluorine atoms and at least one anionic or nonionic hydrophilic group, and is subjected to processing by a heat-developing machine having a stock tray for heat-developable photosensitive materials placed at the height of not more than 55 cm above the floor.

(2) The heat-developable photosensitive material as described in item (1) above, wherein the heat-developing machine has an exposure section for the heat-developable photosensitive material arranged above the stock tray for heat-developable photosensitive materials.

(3) The heat-developable photosensitive material as described in item (1) or (2) above, wherein the heat-developing machine has at least 3 stock trays for heat-developable photosensitive materials.

(4) The heat-developable photosensitive material as described in any one of items (1) to (3) above, wherein the fluorine compound is a compound represented by the following formula (F):

(F)

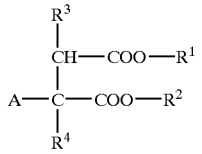

In formula (F), $R^1$ and $R^2$ each represent a substituted or unsubstituted alkyl group, provided that at least one of $R^1$ and $R^2$ represents a fluorinated alkyl group having not less than 2 carbon atoms and not more than 13 fluorine atoms; $R^3$ and R4 each represent a hydrogen atom or a substituted or unsubstituted alkyl group; A represents —Lb—$SO_3M$; M represents a hydrogen atom, a metallic atom or an ammonium group; and Lb represents a single bond or a substituted or unsubstituted alkylene group.

(5) The heat-developable photosensitive material as described in item (4) above, wherein both $R^3$ and $R^4$ in the compound represented by formula (F) represent hydrogen atoms.

(6) The heat-developable photosensitive material as described in item (4) or (5) above, wherein Lb in the compound represented by formula (F) represents a —$CH_2$— group.

(7) The heat-developable photosensitive material as described in any one of items (4) to (6) above, wherein at least one of $R^1$ and $R^2$ in the compound represented by formula (F) represents a fluorinated alkyl group having not less than 4 carbon atoms and not more than 11 fluorine atoms.

(8) The heat-developable photosensitive material as described in any one of items (4) to (7) above, wherein $R^1$ and $R^2$ in the compound represented by formula (F) each represent a fluorinated alkyl group having not less than 4 carbon atoms and not more than 11 fluorine atoms.

(9) A method of processing a heat-developable photosensitive material comprising processing a heat-developable photosensitive material, which comprises a light-sensitive layer containing a light-sensitive silver halide, a light-insensitive organic silver salt, a thermal developer and a binder and a protective layer containing a fluorine compound having at least one fluorinated alkyl group having not less than 2 carbon atoms and not more than 13 fluorine atoms and at least one anionic or nonionic hydrophilic group by a heat-developing machine having a stock tray for heat-developable photosensitive materials placed at the height of not more than 55 cm above the floor.

DETAILED DESCRIPTION OF THE INVENTION

Figure 1A:
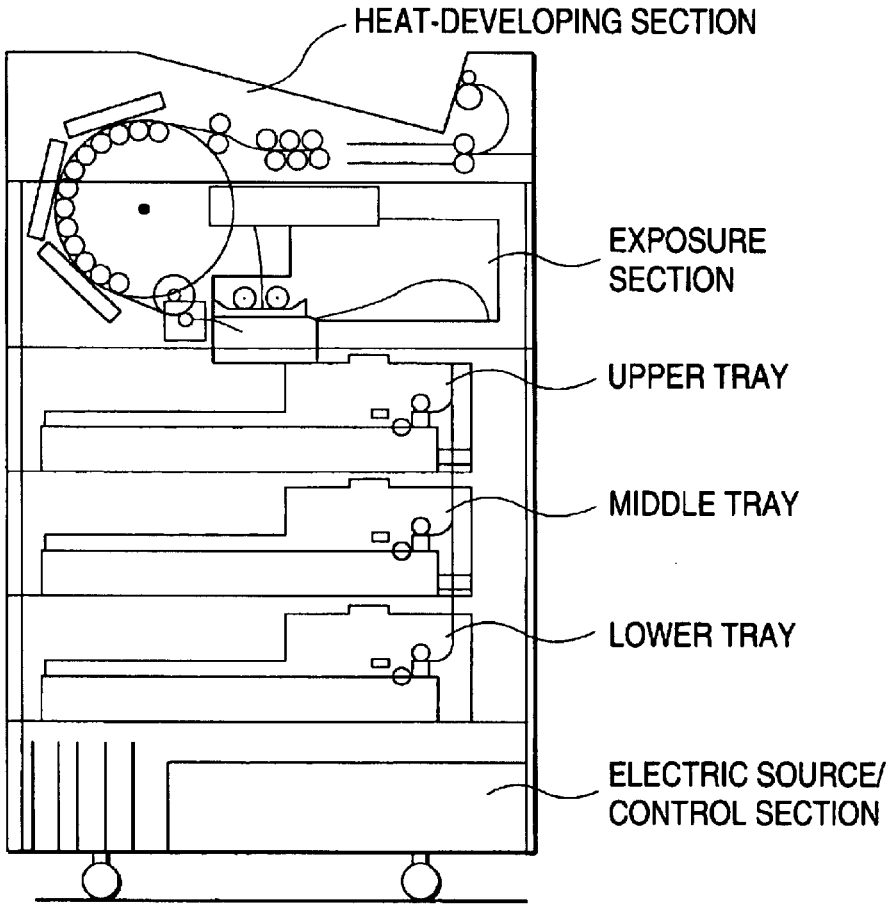
FIG. 1A is a schematic view showing a heat-developing machine according to the typical embodiment of the invention.

The invention will be described in more detail below.

(Description of Fluorine Compound)

First of all, the fluorine compound having at least one fluorinated alkyl group having not less than 2 carbon atoms and not more than 13 fluorine atoms and at least one anionic or nonionic hydrophilic group which is incorporated into the heat-developable photosensitive material of the invention is described in detail below. The invention is based on the finding that troubles of heat-developable photosensitive material due to adhesion of dust, which is inherently present in large amounts in the area close to the floor, can be prevented by the incorporation of the specific fluorine compound.

The fluorine compound may have any structure as far as it has at least one fluorinated alkyl group having not less than 2 carbon atoms and not more than 13 fluorine atoms and at least one anionic or nonionic hydrophilic group.

A number of fluorine atoms included in the fluorinated alkyl group is not more than 13, preferably from 3 to 12, and more preferably from 5 to 9. A number of carbon atoms included in the fluorinated alkyl group is not less than 2, preferably from 4 to 16, more preferably from 5 to 12, and still more preferably from 6 to 10.

The fluorine compound for use in the invention preferably has two or more fluorinated alkyl groups each having not less than 2 carbon atoms and not more than 13 fluorine atoms. In view of ease of synthesis, it is preferred that such two or more fluorinated alkyl groups are the same groups.

The fluorinated alkyl group is preferably a group represented by the following formula (1):

$$\text{—Lb'-Raf-W} \qquad (1)$$

In formula (1), Lb' represents a substituted or unsubstituted alkylene group, a substituted or unsubstituted alkyleneoxy group or a divalent group formed by combining these groups. The substituent may be any group and preferably includes an alkenyl group, an aryl group, an alkoxy group, a halogen atom (preferably, chlorine atom), a carboxylic acid ester group, a carbonamido group, a carbamoyl group, an oxycarbonyl group and a phosphoric acid ester group. Lb' has preferably not more than 8 carbon atoms, and more preferably not more than 4 carbon at6 ms. Lb' is preferably an unsubstituted alkylene group.

Raf represents a perfluoroalkylene group having from 1 to 6 carbon atoms, and is preferably a perfluoroalkylene group having from 2 to 4 carbon atoms. The term "perfluoroalkylene group" as used herein means a group where all hydrogen atoms of an alkylene group are replaced with fluorine atoms. The perfluoroalkylene group may be straight chain or branched or may have a cyclic structure.

W represents a hydrogen atom, a fluorine atom or an alkyl group, and is preferably a hydrogen atom or a fluorine atom.

Specific examples of the fluorinated alkyl group include —$C_2F_5$ group, —$C_3F_7$ group, —$C_4F_9$ group, —$C_5F_{11}$ group, —$CH_2$—$C_4F_8$ group, —$C_4F_8$—H group, —$C_2H_4$—$C_4F_9$ group, —$C_4H_8$—$C_4F_9$ group, —$C_6H_{12}$—$C_4F_9$ group, —$C_8H_{16}$—$C_4F_9$ group, —$C_4H_8$—$C_2F_5$ group, —$C_4H_8$—$C_3F_7$ group, —$C_4H_8$—$C_5F_{11}$ group, —$C_8H_{16}$—$C_2F_5$ group, —$C_2H_4$—$C_4F_8$—H group, —$C_4H_8$—$C_4F_9$—H group, —$C_6H_{12}$—$C_4F_8$—H group, —$C_6H_{12}$—$C_2F_4$—H group, —$C_8H_{16}$—$C_2F_4$—H group, —$C_6H_{12}$—$C_4F_8$—$CH_3$ group, —$C_2H_4$—$C_3F_7$ group, —$C_2H_4$—$C_5F_{11}$ group, —$C_4H_8$—$CF(CF_3)_2$ group, —$CH_2CF_3$ group, —$C_4H_8$—$CH(C_2F_5)_2$ group, —$C_4H_8$—$CH(CF_3)_2$ group, —$C_4H_8$—$C(CF_3)_3$ group, —$CH_2$—$C_4F_8$—H group, —$CH_2$—$C_6F_{12}$—H group and —$CH_2CH_2$—$C_6F_{13}$ group.

The anionic hydrophilic group contained in the fluorine compound means an acidic group having a pKa of not more than 7, or an alkali metal salt or ammonium salt thereof. Specific examples of the anionic hydrophilic group include a sulfo group, a carboxy group, a phosphonic acid group, a carbamoylsulfamoyl group, a sulfamoylsulfamoyl group, an acylsulfamoyl group and salts thereof. Among these groups, a sulfo group, a carboxy group, a phosphonic acid group and salts thereof are preferred, and a sulfo group and a salt thereof are more preferred. Examples of the cation species for forming the salt include lithium, sodium, potassium, cesium, ammonium, tetramethylammonium, tetrabutylammonium and methylpyridinium. Among these cations, lithium, sodium, potassium and ammonium are preferred.

Examples of the nonionic hydrophilic group contained in the fluorine compound include a hydroxy group and a polyalkyleneoxy group. Among these groups, a polyalkyleneoxy group is preferred.

The polyalkyleneoxy group and the anionic hydrophilic group described above may be simultaneously contained in the same molecule of the fluorine compound, and this is a preferred embodiment of the invention. Also, a combination use of an anionic fluorine compound and a nonionic fluorine compound is effective and particularly preferred.

The fluorine compound more preferably used in the invention is a compound represented by the following formula (F):

(F)

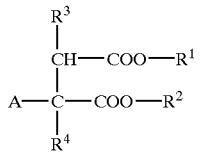

In formula (F), $R^1$ and $R^2$ each independently represent a substituted or unsubstituted alkyl group, provided that at least one of $R^1$ and $R^2$ represents a fluorinated alkyl group having not less than 2 carbon atoms and not more than 13 fluorine atoms. When $R^1$ or $R^2$represents an alkyl group other than the fluorinated alkyl group, the alkyl group is preferably an alkyl group having from 2 to 18 carbon atoms, and more preferably an alkyl group having from 4 to 12 carbon atoms. $R^3$ and $R^4$ each independently represent a hydrogen atom or a substituted or unsubstituted alkyl group.

Specific examples of the fluorinated alkyl group represented by $R_1$ or $R_2$ include the groups described above. Preferred structure of the fluorinated alkyl group is also same as the structure represented by formula (1). Preferred structures among those structures are also the same as those described above for the fluorinated alkyl group. It is preferred that the alkyl groups represented by both $R_1$ and $R_2$ are the fluorinated alkyl groups described above.

The substituted or unsubstituted alkyl group represented by $R_3$ or $R_4$ may be straight chain or branched or may have a cyclic structure. The substituent may be any substituent and preferably includes an alkenyl group, an aryl group, an alkoxy group, a halogen atom (preferably chlorine atom), a carboxylic acid ester group, a carbonamido group, a carbamoyl group, an oxycarbonyl group and a phosphoric acid ester group.

A represents —Lb—$SO_3M$. M represents a hydrogen atom or a cation including a metal ion and an ammonium group. Preferred examples of the cation represented by M include an alkali metal ion (e.g., lithium ion, sodium ion or potassium ion), an alkaline earth metal ion (e.g., barium ion or calcium ion) and ammonium group. Among these cations, lithium ion, sodium ion, potassium ion and ammonium group are more preferred, and lithium ion, sodium ion and potassium group are still more preferred. The cation may be appropriately selected according to the total number of carbon atoms, the substituent and the degree of branching in the alkyl group contained in the compound represented by formula (F). In the case where the total number of carbon atoms included in $R^1$, $R^2$, $R^3$ and $R^4$ is not less than 16, lithium ion is preferred from the standpoint of attaining both solubility (particularly solubility in water) and antistatic property or coating uniformity.

Lb represents a single bond or a substituted or unsubstituted alkylene group. The substituent includes preferably those described for $R_3$ above. In the case where Lb is an alkylene group, Lb preferably has a carbon number of not more than 2. Lb is preferably a single bond or a —$CH_2$— group, and most preferably a —$CH_2$— group.

With respect to the compound represented by formula (F), it is more preferred to combine the respective preferred embodiments with each other.

Specific examples of the fluorine compound for use in the invention are set forth below, but the present invention should not be construed as being limited thereto.

In the following structure descriptions of compounds, unless otherwise indicated, the alkyl group and perfluoroalkyl group mean an alkyl group and perfluoroalkyl group having a straight chain structure, respectively.

(F-1)

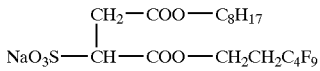

(F-2)

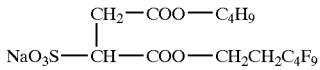

(F-3)

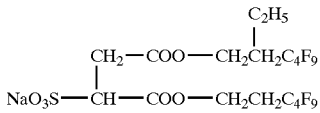

(F-4)

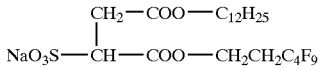

(F-5)

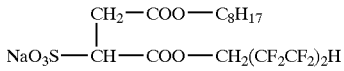

(F-6)

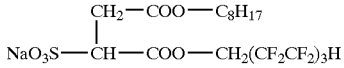

(F-7)

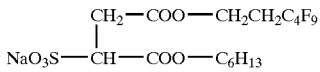

(F-8)

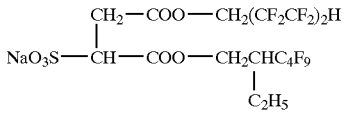

(F-9)

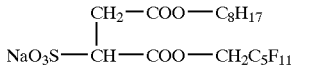

(F-10)

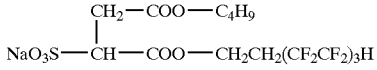

(F-11)

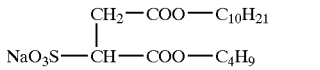

(F-12)

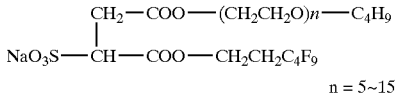

n = 5~15

(F-13)

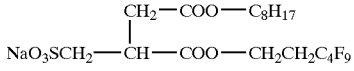

(F-14)

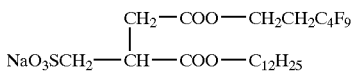

(F-15)

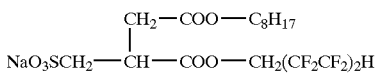

(F-16)

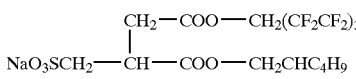

-continued (F-17)

$NaO_3S-CH(CH_2-COO-CH_2CH_2C_4H_9)-COO-CH_2CH_2C_4H_9$ (F-18)

$NaO_3S-CH(CH_2-COO-CH_2CH_2C_2H_7)-COO-CH_2CH_2C_2H_7$ (F-19)

$NaO_3S-CH(CH_2-COO-CH_2CH_2C_5H_{11})-COO-CH_2CH_2C_5H_{11}$ (F-20)

$NaO_3S-CH(CH_2-COO-CH_2C_4F_9)-COO-CH_2C_4F_9$ (F-21)

$NaO_3S-CH(CH_2-COO-C_4F_9)-COO-C_4F_9$ (F-22)

$NaO_3S-CH(CH_2-COO-C_4F_9)-COO-CH_2CH_2C_4F_9$ (F-23)

$NaO_3S-CH(CH_2-COO-CH_2CH_2CF(CF_3)_2)-COO-CH_2CH_2CF(CF_3)_2$ (F-24)

$NaO_3S-CH(CH_2-COO-CH_2CH_2C_2F_5)-COO-CH_2CH_2C_4F_9$ (F-25)

$NaO_3S-CH(CH_2-COO-CH_2(CF_2CF_2)_2H)-COO-CH_2(CF_2CF_2)_2H$ (F-26)

$NaO_3S-CH(CH_2-COO-CH_2(CF_2CF_2)_3H)-COO-CH_2(CF_2CF_2)_3H$ (F-27)

$NaO_3S-CH(CH_2-COO-CH_2CF_2CF_2H)-COO-CH_2(CF_2CF_2)_3H$ (F-28)

$NaO_3S-CH(CH_2-COO-(CH_2CH_2O)nC_4F_9)-COO-(CH_2CH_2O)nC_4F_9$ n = 5~15

(F-29)

$NaO_3SCH_2-CH(CH_2-COO-CH_2CH_2C_4F_9)-COO-CH_2CH_2C_4F_9$ (F-30)

$NaO_3SCH_2-CH(CH_2-COO-CH_2CH_2C_3F_7)-COO-CH_2CH_2C_3F_7$ (F-31)

$NaO_3SCH_2-CH(CH_2-COO-CH_2CH_2C_5F_{11})-COO-CH_2CH_2C_5F_{11}$ (F-32)

$NaO_3SCH_2-CH(CH_2-COO-CH_2CH_2C_6F_{13})-COO-CH_2CH_2C_6F_{13}$ (F-33)

$NaO_3SCH_2-CH(CH_2-COO-CH_2(CF_2CF_2)_2H)-COO-CH_2(CF_2CF_2)_2H$ (F-34)

$NaO_3SCH_2-CH(CH_2-COO-CH_2(CF_2CF_2)_3H)-COO-CH_2(CF_2CF_2)_3H$ (F-35)

$NaO_3SCH_2-CH(CH_2-COO-CH_2CF_2CF_2H)-COO-CH_2(CF_2CF_2)_3H$

-continued (F-36)

$NaO_3SCH_2-CH(CH_2-COO-CH_2CH_2CF(CF_3)_2)-COO-CH_2CH_2CF(CF_3)_2$ (F-37)

$NaO_3SCH_2-CH(CH_2-COO-CH_2CH(C_2F_5)_2)-COO-CH_2CH(C_2F_5)_2$ (F-38)

$NaO_3S-CH(CH_3)-CH(COO-CH_2CH_2C_4F_9)-COO-CH_2CH_2C_4F_9$ (F-39)

$NaO_3S-CH(CH(COO-CH_2CH_2C_4F_9)-CH(COO-CH_2CH_2C_4F_9)-COO-CH_2CH_2C_4F_9)-COO-CH_2CH_2C_4F_9$ (F-40)

$NaO_3S-CH(CH(COO-CH_2(CF_2C_2F)_2H)-CH(COO-CH_2(CF_2CF_2)_2H)-COO-CH_2(CF_2CF_2)_2H)-COO-CH_2(CF_2CF_2)_2H$ (F-41)

$NaO_3SCH_2CH_2-CH(CH_2-COO-CH_2CH_2C_4F_9)-COO-CH_2CH_2C_4F_9$ (F-42)

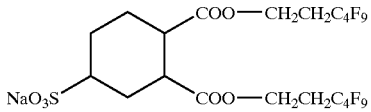

(F-43)

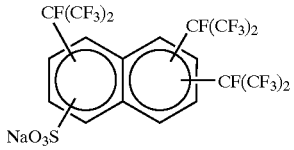

(F-44)

$NaO_3SCH_2-CH(CH_2-COO-C_8H_17)-P(=O)(O-CH_2CH_2C_4F_9)-O-CH_2CH_2C_4F_9$ (F-45)

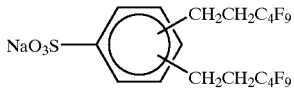

(F-46)

$NaO_3SCH_2-C(CH_2-COO-CH_2(CF_2CF_2)_2H)(COO-CH_2(CF_2CF_2)_2H)-CH_2-COO-CH_2(CF_2CF_2)_2H$ (F-47)

$KO_3S-CH(CH_2-COO-C_8H_17)-COO-CH_2CH_2C_4F_9$ (F-48)

$LiO_3S-CH(CH_2-COO-C_8H_17)-COO-CH_2(CF_2CF_2)_3H$ (F-49)

$LiO_3S-CH(CH_2-COO-C_8H_17)-COO-CH_2CH_2C_4F_9$

-continued (F-50)

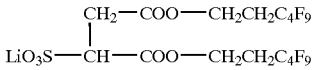

(F-51)

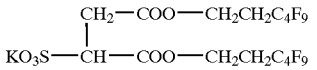

(F-52)

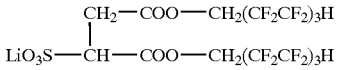

(F-53)

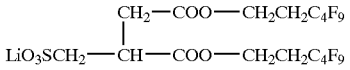

(F-54)

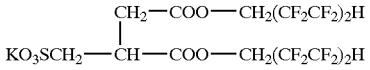

(F-55)

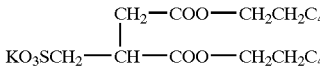

(F-56)

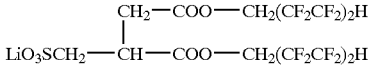

The fluorine compound having a fluorinated alkyl group according to the invention is incorporated into a protective layer, which is the outermost hydrophilic layer of heat-developable photosensitive material. By the incorporation of the fluorine compound into the protective layer, owing to the structure thereof described above the excellent properties, for example, prevention of adhesion of dust, improvements in preservation stability and dependence on environment in use can be achieved. It is also effective in view of improvements in antistatic property and coating uniformity.

The fluorine compound according to the invention should be present in at least one of a protective layer provided on the light-sensitive layer side and a protective layer provided on the back side. The fluorine compound preferably exists in the protective layer provided on the light-sensitive layer side, and more preferably in both the protective layer provided on the light-sensitive layer side and the protective layer provided on the back side.

The coating composition containing the fluorine compound according to the invention is described below.

The aqueous coating composition containing the fluorine compound, which is used for the heat-developable photosensitive material of the invention, contains a medium in which the fluorine compound is dissolved and/or dispersed. The coating composition may contain a surfactant other than the fluorine compound according to the invention, if desired. In addition, the coating composition may appropriately contain other components depending on its purpose. The medium used in the aqueous coating composition according to the invention is preferably an aqueous medium. Examples of the aqueous medium include water and a mixed solvent of water and an organic solvent other than water (for example, methanol, ethanol, isopropyl alcohol, n-butanol, methyl cellosolve, dimethylformamide or acetone). The medium for the coating composition containing the fluorine compound according to the invention preferably contains not less than 50% by weight of water.

In the invention, the fluorine compounds according to the present invention may be used individually or as a mixture of two or more thereof. Other surfactant may also be used in combination with the fluorine compound according to the invention. The surfactant, which can be used in combination, includes an anionic surfactant, a cationic surfactant and a nonionic surfactant. Also, the surfactant used in combination may be a polymer surfactant or may be a fluorine-containing surfactant other than the surfactant according to the invention. The surfactant used in combination is preferably an anionic or nonionic surfactant. Examples of the surfactant which can be used in combination include surfactants described, for example, in JP-A-62-215272 (pages 649 to 706), *Research Disclosure* (*RD*), Item 17643, pages 26 to 27 (December, 1978), ibid., Item 18716, page 650 (November, 1979), and ibid., Item 307105, pages 875 to 876 (November, 1989).

A polymer compound is a representative example of the other components, which can be used in combination. The polymer compound may be a polymer soluble in an aqueous medium (hereinafter referred to as a "soluble polymer") or may be a dispersion of polymer (so-called a polymer latex). The soluble polymer is not particularly limited and examples thereof include gelatin, polyvinyl alcohol, casein, agar, gum arabic, hydroxyethyl cellulose, methyl cellulose and carboxymethyl cellulose. Examples of the polymer latex include homopolymers and copolymers of various vinyl monomers [for example, acrylate derivatives, methacrylate derivatives, acrylamide derivatives, methacrylamide derivatives, styrene derivatives, conjugated diene derivatives, N-vinyl compounds, O-vinyl compounds, vinyl nitrites and other vinyl compounds (e.g., ethylene or vinylidene chloride)], and dispersions of condensation polymers (e.g., polyesters, polyurethanes, polycarbonates or polyamides). Specific examples of such polymer compound include polymer compounds described, for example, in JP-A-62-215272 (pages 707 to 763), *Research Disclosure* (*RD*), Item 17643, page 651 (December, 1978), ibid., Item 18716, page 650 (November, 1979), and ibid., 307105, pages 873 to 874 (November, 1989).

The aqueous coating composition containing the fluorine compound according to the invention and a hydrophilic colloid (for example, gelatin) may further contain other additives, for example, a surfactant, a matting agent, a slipping agent, a colloidal silica or a gelatin plasticizer.

In the invention, the amount of fluorine compound used is not particularly limited as far as the desired effects are achieved. The amount thereof can be appropriately determined, for example, according to the structure of the compound used, the part where the compound is used, the kind and amount of other material contained in the composition. For instance, in case of using the fluorine compound in a coating solution for a hydrophilic colloid (gelatin) layer as the uppermost layer of heat-developable photosensitive material, the concentration of the fluorine compound in the coating composition is preferably from 0.003 to 0.5% by weight, and preferably from 0.03 to 5% by weight based on a gelatin solid content.

(Description of Height of Stock Tray for Heat-Developable Photosensitive Material Above the Floor)

A heat-developing machine has a tray for stock of unexposed heat-developable photosensitive materials. In a conventional heat-developing machine, a section for exposing the heat-developable photosensitive material is positioned under the stock tray and as a result, the stock tray is arranged in a place away from the floor. Also, a number of the trays is one or two per heat-developing machine. Thus, even the lowest tray is still placed at the height of not less than 60 cm above the floor. On the contrary, the heat-developing machine according to the invention has a feature that a stock tray is placed at the height of not more than 55 cm above the floor. Placing the section for exposing the heat-developable photosensitive material above the stock tray can reduce a path length of conveying heat-developable photosensitive material and makes it possible to conduct a rapid processing, but a position of the stock tray for heat-developable photosensitive material becomes low by just that much. To increase the number of trays to 3 also results in lowering the position of stock tray for heat-developable photosensitive material. The height of tray is preferably not more than 50 cm above the floor, and more preferably not more than 45 cm above the floor. The term "height of tray" as used herein means a height of the underneath heat-developable photosensitive material of a stack thereof and is expressed by a distance measured from the floor. When the stock tray is placed on such a low position, an inconceivable amount of fine foreign matters are introduced into the tray. There is a problem that, particularly, dust floating near the floor and dust generated by the operation get into the tray and adhere on the heat-developable photosensitive material.

Figure 1B:
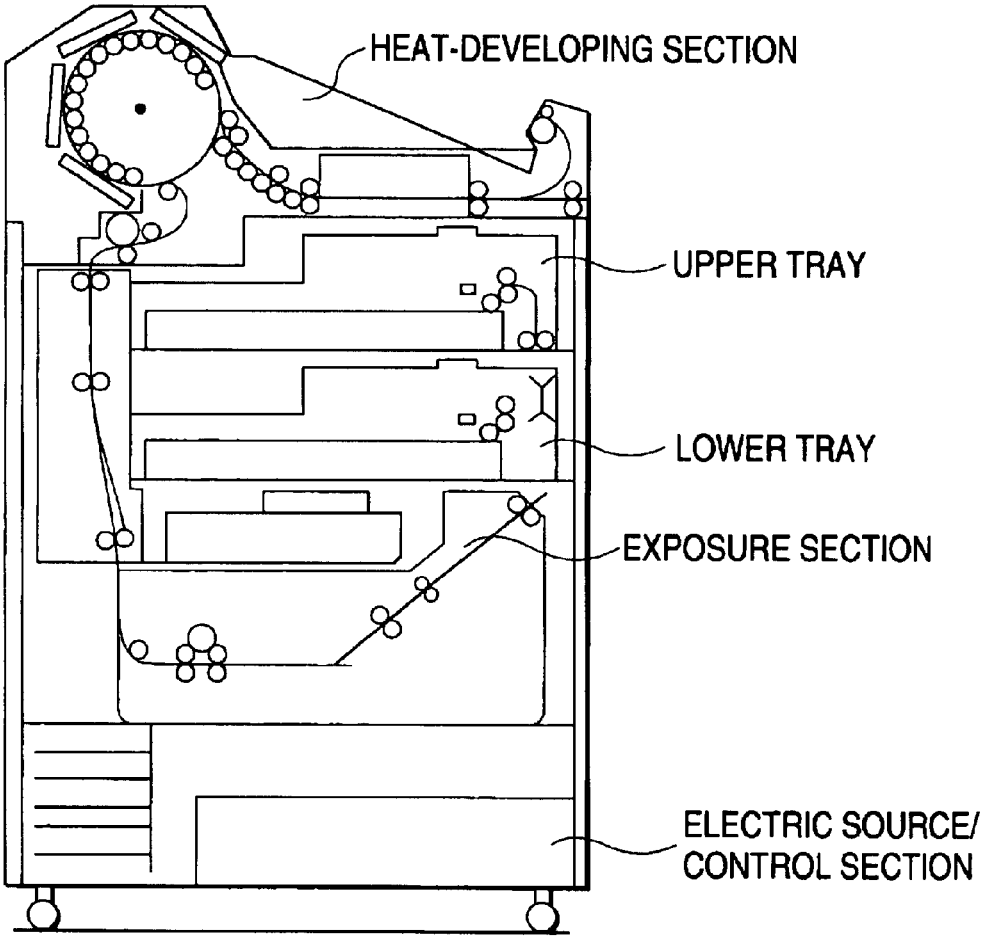
FIG. 1B is a schematic view showing a conventional heat-developing machine.

Thus, the heat-developing machine according to the invention preferably has the exposure section positioned above the stock tray for heat-developable photosensitive material. It is also preferable for the machine to have at least 3 stock trays. In FIG. 1A, a schematic cross sectional view of a heat-developing machine according to a preferred embodiment of the invention is shown. For comparison, a schematic cross sectional view of a conventional heat-developing machine is shown in FIG. 1B. With such an arrangement as shown in FIG. 1A, it is possible to make the machine compact and to increase the number of trays to 3 or more.

(Description of Organic Silver Salt)

The organic silver salt for use in the present invention is a silver salt that is relatively stable to light but functions as a silver ion supplier to form a silver image when heated at 80° C. or higher in the presence of an exposed light-sensitive silver halide and a reducing agent. The organic silver salt may be an appropriate organic silver salt that can be reduced by the reducing agent and supply a silver ion. Such a light-insensitive organic silver salt is described, for example, in JP-A-10-62899, Paragraph Nos. [0048] to [0049] (the term "JP-A" as used herein means an "unexamined published Japanese patent application"), EP-A-803764, from page 18, line 24 to page 19, line 37, EP-A-962812, JP-A-11-349591, JP-A-2000-7683 and JP-A-2000-72711. Of the organic silver salts, a silver salt of aliphatic hydrocarbon acid, particularly a silver salt of long-chain aliphatic carboxylic acid having from 10 to 30 carbon atoms, preferably from 15 to 28 carbon atoms (fatty acid silver salt) is preferably used. Preferred examples of such a fatty acid silver salt include silver lignocerate, silver behenate, silver arachidate, silver stearate, silver oleate, silver laurate, silver caprate, silver myristate, silver palmitate, silver erucate and a mixture thereof. Of the fatty acid silver salts, those having a silver behenate content of not less than 50 mol % are preferably used in the invention. The silver behenate content is more preferably not less than 85 mol %, and still more preferably not less than 95 mol %. In addition, a content of erucic acid in the fatty acid silver salt is preferably not more than 2 mol %, more preferably not more than 1 mol %, and still more preferably not more than 0.1 mol %.

The shape of organic silver salt for use in the invention is not particularly restricted, and any shape, for example, an acicular shape, a rod-like shape, a tabular shape or a scaly shape may be used.

The organic silver salt of a scaly shape is preferably used in the invention. Also, the organic silver salt having a short acicular shape having a ratio of the major axis to the minor axis of not more than 5, a rectangular shape, a cubic shape or in an irregular shape such as a potato-like shape is preferably used. These organic silver salt grains have a feature of less fog at the time of heat development, in comparison with organic silver salt grains having a long acicular shape having the ratio of the major axis to the minor axis of more than 5. Particularly, the organic silver salt grains having the ratio of the major axis to the minor axis of not more than 3 are preferred in view of improvement in the mechanical stability of coated film containing it. The term "organic silver salt of scaly shape" as used in the invention is defined in the following manner. An organic silver salt grain is observed by an electron microscope. The shape of the organic silver salt grain is approximated to a rectangular solid, and when the edge lengths of the rectangular solid are taken as a, b and c from the shortest (wherein c may be equal to b), x is calculated using the shorter lengths, a and b, as follows:

$$x=b/a$$

In such a manner, x values of about 200 grains are determined. When the grains satisfy a relation of x(average) $\geqq 1.5$, wherein x(average) means the average of the x values determined, they are referred to as scaly grains. The grains satisfying a relation of $30 \geqq x(\text{average}) \geqq 1.5$ are preferred, and those satisfying the relation of $15 \geqq x(\text{average}) \geqq 1.5$ are more preferred. By the way, the acicular grains are defined as grains satisfying the relation of $1 \leqq x(\text{average}) < 1.5$.

In the scaly grain, a can be regarded as thickness of a tabular grain having a surface with edge lengths of b and c as the principal plane. The average of a value is preferably from 0.01 to 0.3 $\mu$m, and more preferably from 0.1 $\mu$m to 0.23 $\mu$m. The average of c/b ratio is preferably from 1 to 6, more preferably from 1 to 4, and still more preferably from 1 to 3.

It is preferred that the grain size distribution of organic silver salt is monodisperse. The monodisperse means that a percentage of each of the values obtained by dividing standard deviations of the lengths of the minor axis and the major axis respectively by the averages of lengths of the minor axis and the major axes respectively is preferably not more than 100%, more preferably not more than 80%, and still more preferably not more than 50%. The shape of organic silver salt can be determined by transmission electron microscopic image of a dispersion of the organic silver salt. Another method for determining the monodispersity is a method of determining a standard deviation of volume weighted average diameter of organic silver salt grain. A percentage of a value (variation coefficient) obtained by dividing the standard deviation by the volume weighted average diameter is preferably not more than 100%, more preferably not more than 80%, and still more preferably not more than 50%. The variation coefficient can be calculated, for example, from the grain size value (volume weighted average diameter) obtained by irradiating an organic silver salt dispersed in a liquid with a laser beam and determining an autocorrelation function of change in fluctuation of light scattered from the organic silver salt with respect to time.

In the production and dispersion of organic silver salt for use in the invention, known methods can be employed. Specifically, methods described, for example, in JP-A-10-62899, EP-A-803763, EP-A-962812, JP-A-11-349591, JP-A-2000-7683, JP-A-2000-72711, JP-A-2001-163889, JP-A-2001-163890, JP-A-2001-163827, JP-A-2001-33907, JP-A-2001-188313, JP-A-2001-83652, JP-A-2002-6442, JP-A-2002-31870 and JP-A-2002-107868 can be referred to.

The presence of light-sensitive silver salt at the time of dispersing the organic silver salt results in increase in fog and severe reduction in sensitivity. Therefore, it is preferable that the dispersion is carried out in the substantial absence of light-sensitive silver salt. In the invention, the amount of light-sensitive silver salt in the aqueous dispersion of the organic silver salt is preferably not more than 1 mole %, more preferably not more than 0.1 mole %, per mole of the organic silver salt. Still more preferably, the light-sensitive silver salt is not added positively to the aqueous dispersion of the organic silver salt.

In the invention, it is possible to prepare a photosensitive material by mixing of an aqueous dispersion of organic silver salt with an aqueous dispersion of light-sensitive silver salt. The mixing ratio of organic silver salt to light-sensitive silver salt can be selected depending on the purpose. The proportion of light-sensitive silver salt to organic silver salt is preferably from 1 to 30 mole %, more preferably from 2 to 20 mole %, and particularly preferably from 3 to 15 mole %. A method of mixing two or more aqueous organic silver salt dispersions with two or more aqueous light-sensitive silver salt dispersions is preferably used for adjustment of photographic characteristics.

The organic silver salt according to the invention can be used in the desired amount. Specifically, the amount of the organic silver salt used is preferably from 0.1 to 5.0 g/m$^2$, more preferably from 0.3 to 3.0 g/m$^2$, and still more preferably from 0.5 to 2.0 g/m$^2$, in terms of the total amount of coated silver including silver halide. In particular, for the purpose of improving image preservability, the total amount of coated silver is preferably not more than 1.8 g/m$^2$, and more preferably not more than 1.6 g/m$^2$. It is possible to obtain a sufficient image density even in such a low amount of coated silver by the use of preferred reducing agent according to the invention.

(Description of Reducing Agent)

The heat-developable photosensitive material of the invention contains a thermal developer, which is a reducing agent for the organic silver salt. The reducing agent for organic silver salt may be any of substances (preferably organic substances) capable of reducing silver ion to metallic silver. Examples of such a reducing agent are described in JP-A-11-65021, paragraphs [0043] to [0045], and EP-A-803764, from page 7, line 34 to page 18, line 12.

As the reducing agent for use in the invention, reducing agents of so-called hindered phenol type having a substituent on the o-position of a phenolic hydroxy group and reducing agents of bisphenol type are preferred. Of the reducing agents, compounds represented by the following formula (R) are more preferably used.

(R)

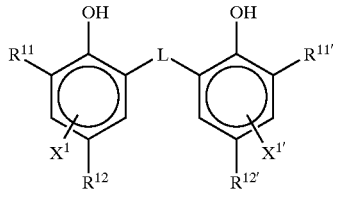

In formula (R) $R^{11}$ and $R^{11'}$ each independently represent an alkyl group containing from 1 to 20 carbon atoms. $R^{12}$ and $R^{12}$ ' each independently represent a hydrogen atom or a substituent capable of substituting on the benzene ring. L represents a —S— group or a —$CHR^{13}$— group. $R^{13}$ represents a hydrogen atom or an alkyl group containing from 1 to 20 carbon atoms. $X^1$ and $X^1$ ' each independently represent a hydrogen atom or a substituent capable of substituting on the benzene ring.

The formula (R) is described in more detail below.

$R^{11}$ and $R^{11'}$ each independently represent a substituted or unsubstituted alkyl group containing from 1 to 20 carbon atoms. The substituent on the alkyl group is not particularly restricted, and preferred examples of the substituent include an aryl group, a hydroxy group, an alkoxy group, an aryloxy group, an alkylthio group, an arylthio group, an acylamino group, a sulfonamido group, a sulfonyl group, a phosphoryl group, an acyl group, a carbamoyl group, an ester group, an ureido group, an urethane group and a halogen atom.

$R^{12}$ and $R^{12'}$ each independently represent a hydrogen atom or a substituent capable of substituting on the benzene ring. $X^1$ and $X^1$ ' also each independently represent a hydrogen atom or a substituent capable of substituting on the benzene ring. Preferred examples of the substituent capable of substituting on the benzene ring include an alkyl group, an aryl group, a halogen atom, an alkoxy group and an acylamino group.

L represents a —S— group or a —$CHR^{13}$— group. $R^{13}$ represents a hydrogen atom or an alkyl group containing from 1 to 20 carbon atoms, which may have a substituent. Examples of the unsubstituted alkyl group represented by $R^{13}$ include methyl, ethyl, propyl, butyl, heptyl, undecyl, isopropyl, 1-ethylpentyl and 2,4,4-trimethylpentyl groups. Examples of the substituent for the alkyl group include the same substituents as described for the alkyl group represented by $R^{11}$.

As $R^{11}$ or $R^{11'}$, a secondary or tertiary alkyl group containing from 3 to 15 carbon atoms is preferred. Specific examples of such an alkyl group include isopropyl, isobutyl, tert-butyl, tert-amyl, tert-octyl, cyclohexyl, cyclopentyl, 1-methylcyclohexyl and 1-methylcyclopropyl groups. The group more preferable as $R^{11}$ or $R^{11}$ ' is a tertiary alkyl group containing from 4 to 12 carbon atoms. Of the groups, tert-butyl, tert-amyl and 1-methylcyclohexyl groups are still more preferred, and a tert-butyl group is particularly preferred.

As $R^{12}$ or $R^{12'}$, an alkyl group containing from 1 to 20 carbon atoms is preferred. Specific examples of such an alkyl group include methyl, ethyl, propyl, butyl, isopropyl, tert-butyl, tert-amyl, cyclohexyl, 1-methylcyclohexyl, benzyl, methoxymethyl and ethoxyethyl groups. Of the groups, methyl, ethyl, propyl, isopropyl and tert-butyl groups are more preferred.

As $X^1$ or $X^{1'}$, a hydrogen atom, a halogen atom or an alkyl group is preferred, and a hydrogen atom is more preferred.

L is preferably a —$CHR^{13}$— group.

$R^{13}$ is preferably a hydrogen atom or an alkyl group containing from 1 to 15 carbon atoms. Preferred examples of such an alkyl group include methyl, ethyl, propyl, isopropyl and 2,4,4-trimethylpentyl groups. A hydrogen atom, a methyl group, an ethyl group, a propyl group or an isopropyl group is particularly preferred as $R^{13}$.

When $R^{13}$ is a hydrogen atom, $R^{12}$ and $R^{12'}$ each represent preferably an alkyl group containing from 2 to 5 carbon atoms, more preferably an ethyl group or a propyl group, and particularly preferably an ethyl group.

When $R^{13}$ is a primary or secondary alkyl group containing from 1 to 8 carbon atoms, $R^{12}$ and $R^{12'}$ each preferably represent a methyl group. As the primary or secondary alkyl group containing from 1 to 8 carbon atoms for $R^{13}$, a methyl group, an ethyl group, a propyl group or an isopropyl group is more preferred, and a methyl group, an ethyl group or a propyl group is still more preferred.

When all of $R^{11}$, $R^{11'}$, $R^{12}$ and $R^{12'}$ are methyl groups, it is preferred that $R^{13}$ is a secondary alkyl group. In this case, an isopropyl group, an isobutyl group or a 1-ethylpentyl group is preferred as the secondary alkyl group for $R^{13}$. Of the groups, an isopropyl group is more preferred.

The heat developability and color tone of developed silver may vary depending on the combination of $R^{11}$, $R^{11'}$, $R^{12}$, $R^{12'}$ and $R^{13}$ in the reducing agent described above. These characteristics can be adjusted by using two or more reducing agents in combination. Depending on the purpose, therefore, it is preferred to use two or more reducing agents in combination.

Specific examples of the compound represented by formula (R) and other reducing agents for use in the invention are set forth below, but the invention should not be construed as being limited thereto.

(R-1)

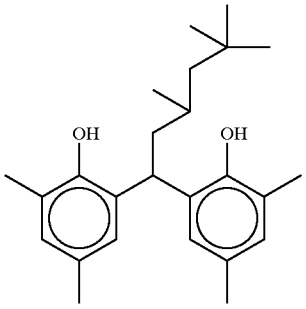

(R-2)

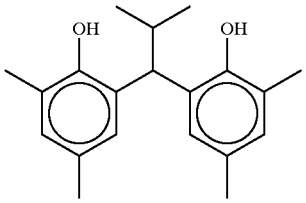

(R-3)

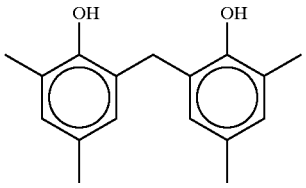

(R-4)

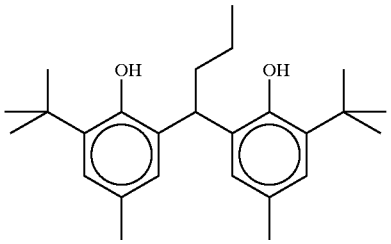

(R-5)

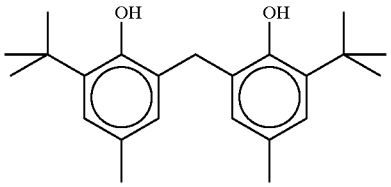

-continued (R-6)

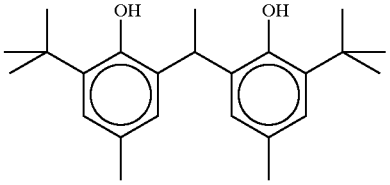

(R-7)

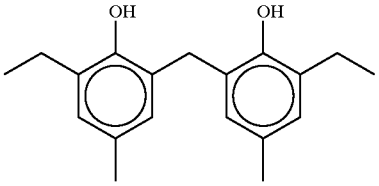

(R-8)

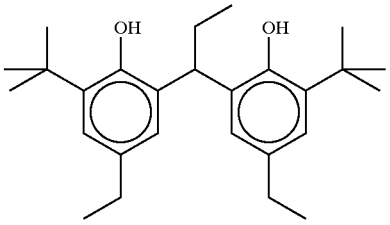

(R-9)

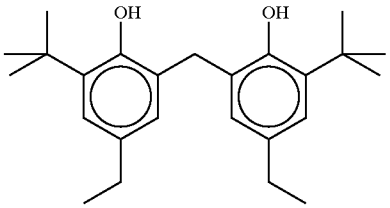

(R-10)

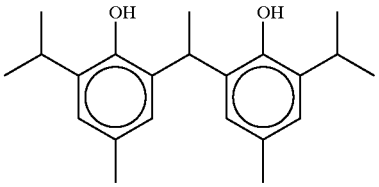

(R-11)

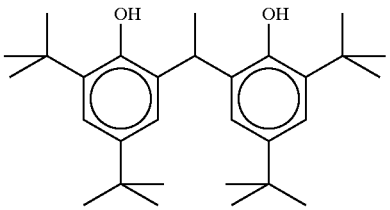

(R-12)

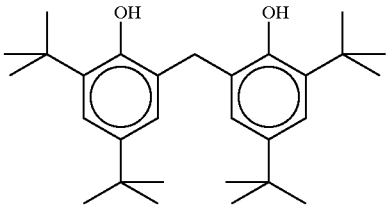

-continued
(R-13)
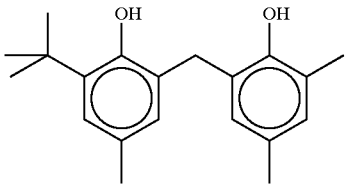
(R-14)
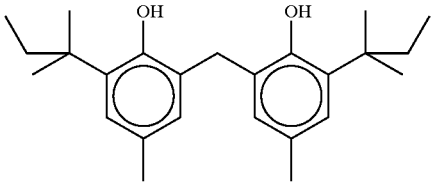
(R-15)
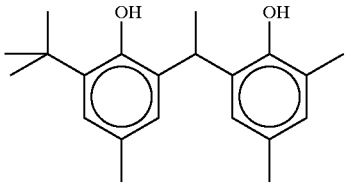
(R-16)
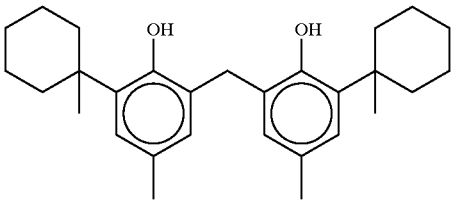
(R-17)
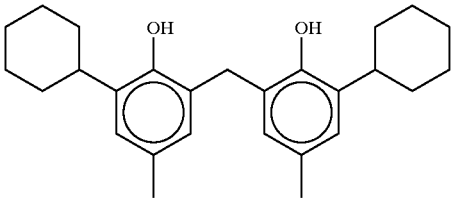
(R-18)
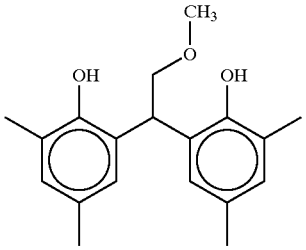
(R-19)
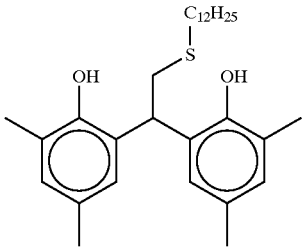
-continued
(R-20)
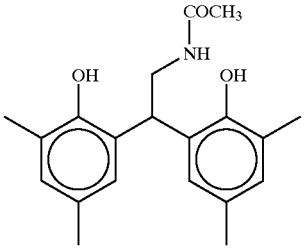
(R-21)
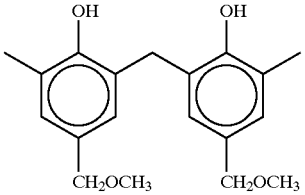
(R-22)
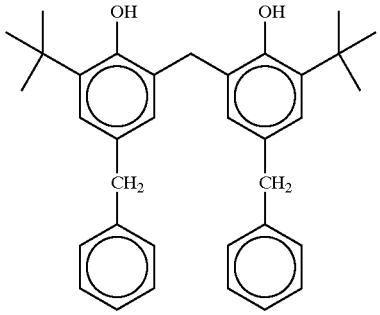
(R-23)
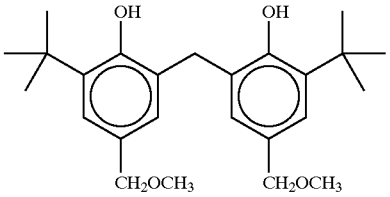
(R-24)
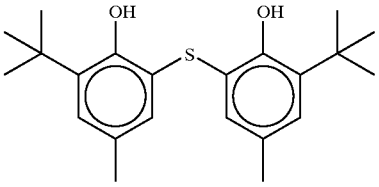
(R-25)
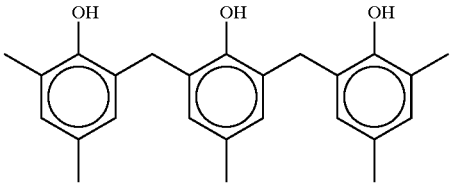
(R-26)
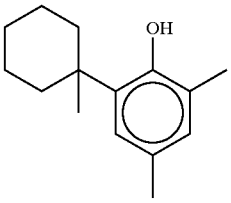

-continued (R-27)

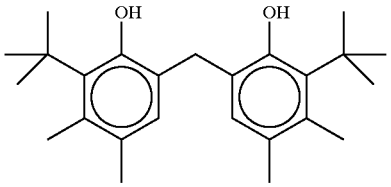

(R-28)

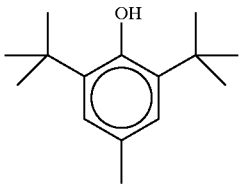

(R-29)

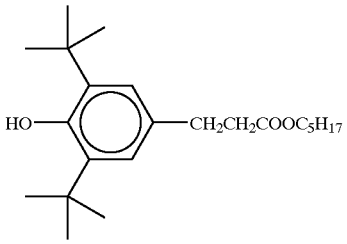

(R-30)

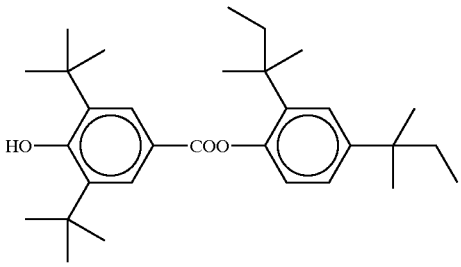

(R-31)

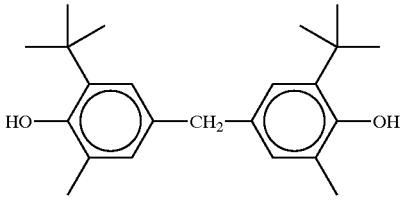

(R-32)

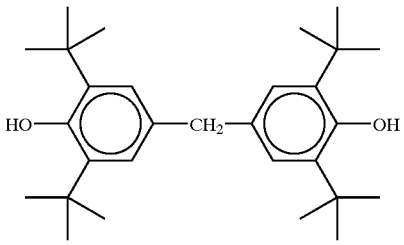

(R-33)

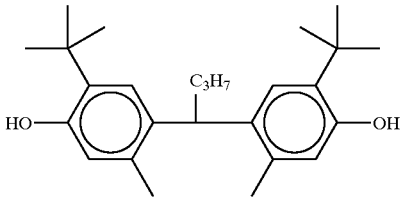

-continued (R-34)

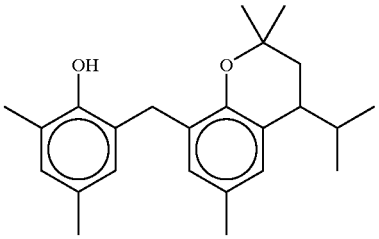

The amount of reducing agent added in the invention is preferably from 0.1 to 3.0 g/m$^2$, more preferably from 0.2 to 1.5 g/m$^2$, and still more preferably from 0.3 to 1.0 g/m$^2$. The amount of reducing agent per mole of silver on the side having the image-forming layer is preferably from 5 to 50 mole %, more preferably from 8 to 30 mole %, and still more preferably from 10 to 20 mole %. It is preferred that the reducing agent is incorporated into the image-forming layer.

The reducing agent may be added to a coating solution in any form, for example, the form of solution, emulsified dispersion or fine particulate solid dispersion, and incorporated into the photosensitive material.

In a well-known emulsified dispersion method, the reducing agent is dissolved using oil, for example, dibutyl phthalate, tricresyl phosphate, glyceryl triacetate or diethyl phthalate and an auxiliary solvent, for example, ethyl acetate or cyclohexanone, and the emulsified dispersion thereof is mechanically prepared.

In a fine particulate solid dispersing method, the reducing agent powder is dispersed in an appropriate solvent, for example, water, by means of a ball mill, a colloid mill, a vibrating ball mill, a sand mill, a jet mill, a roller mill or an ultrasonic wave, thereby preparing the solid dispersion thereof. The dispersion may be performed in the presence of a protective colloid (e.g., polyvinyl alcohol) or a surfactant (e.g., an anionic surfactant such as sodium triisopropylnaphthalenesulfonate, which is a mixture of those differing in substitution positions of three isopropyl groups). In the mills described above, beads such as zirconia beads are ordinarily used as dispersion media. In some cases, therefore, the dispersion is contaminated with zirconium dissolved from the beads. The zirconium content in the dispersion is ordinarily in the range of from 1 to 1,000 ppm, though it depends on dispersing conditions. As far as the zirconium content in the photosensitive material is not higher than 0.5 mg per gram of silver, zirconium produces no adverse effects in practical use.

Into the aqueous dispersion of reducing gent, it is preferred to incorporate an antiseptic (e.g., benzisothiazolinone sodium salt).

In the invention, the reducing agent is preferably used as the solid dispersion.

(Description of Development Accelerator)

In the heat-developable photosensitive material of the invention, the sulfonamidophenol compounds represented by formula (A) described in JP-A-2000-267222 and JP-A-2000-330234, the hindered phenol compounds represented by formula (II) described in JP-A-2001-92075, the hydrazine compounds represented by formula (I) described in JP-A-10-62895 and JP-A-11-15116 and represented by formula (1) described in JP-A-2002-278017, and the phenol or naphthol compounds represented by formula (2) described in JP-A-2001-264929 are preferably used as development accelerators. The development accelerator is ordinarily used in an amount of from 0.1 to 20 mole %, preferably from 0.5 to 10 mole %, and more preferably from 1 to 5 mole %, based on the reducing agent used. The development accelerator can be introduced into the photosensitive material in accordance with the same method as used for the reducing agent. In particular, it is preferred that the development accelerator is added in the form of a solid dispersion or an emulsified dispersion thereof. In the case of adding the development accelerator as the emulsified dispersion, it is preferred to prepare the emulsified dispersion by dispersing the development accelerator using both a high boiling solvent, which is a solid at ambient temperature, and an auxiliary solvent having a low boiling point, or to prepare a so-called oil-less emulsified dispersion by dispersing the development accelerator without using the high boiling solvent.

Of the development accelerators described above, the hydrazine compounds represented by formula (1) described in JP-A-2002-278017 and the phenol or naphthol compounds represented by formula (2) described in JP-A-2001-264929 are particularly preferably used in the invention.

Specific preferred examples of the development accelerator for use in the invention are set forth below, but the invention should not be construed as being limited thereto.

(A-1)

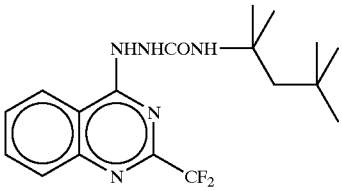

(A-2)

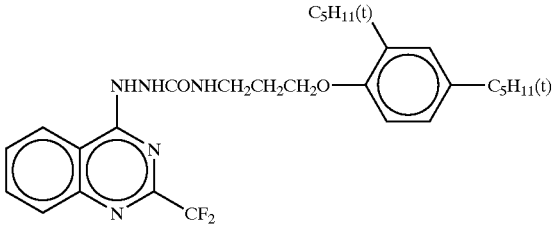

(A-3)

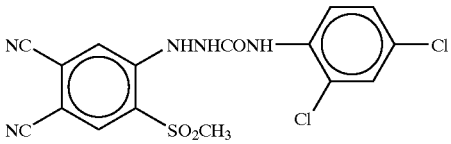

(A-4)

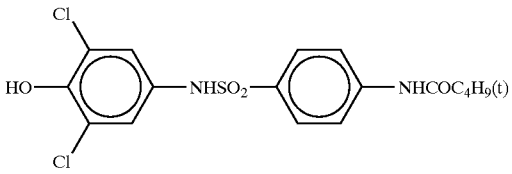

(A-5)

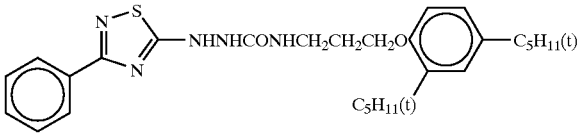

-continued (A-6)

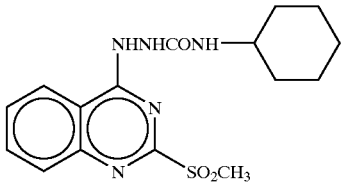

(A-7)

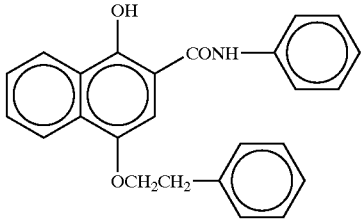

(A-8)

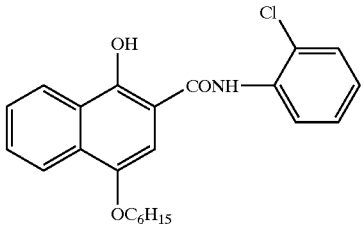

(A-9)

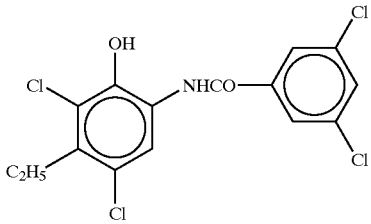

(A-10)

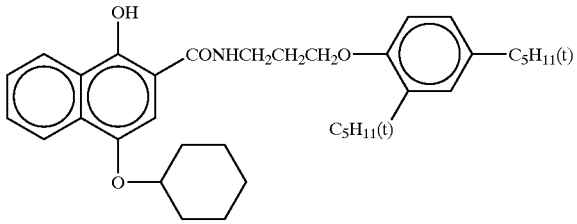

(Description of Hydrogen Bong-forming Compound)

When the reducing agent used in the invention has an aromatic hydroxy group (—OH), especially in the cases of using the bisphenol compound as described above, a non-reducing compound having a group capable of forming a hydrogen bond with the hydroxy group is preferably used in combination. Examples of the group capable of forming a hydrogen bond together with a hydroxy group or an amino group include a phosphoryl group, a sulfoxido group, a sulfonyl group, a carbonyl group, an amido group, an ester group, a urethane group, a ureido group, a tertiary amino group and a nitrogen-containing aromatic group. Of such compounds, those having a phosphoryl group, a sulfoxido group, an amido group (not having >N—H moiety but being blocked in the form of >N—Ra, wherein Ra is a substituent other than H), a urethane group (not having >N—H moiety but being blocked in the form of >N—Ra, wherein Ra is a substituent other than H) or a ureido group (not having >N—H moiety but being blocked in the form of >N—Ra, wherein Ra is a substituent other than H) are preferred.

The hydrogen bond-forming compound particularly preferably used in the invention is a compound represented by the following formula (D):

(D)

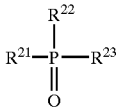

In formula (D), $R^{21}$ to $R^{23}$ each independently represent an alkyl group, an aryl group, an alkoxy group, an aryloxy group, an amino group or a heterocyclic group, each of which may be unsubstituted or may have a substituent. Examples of the substituent for the group represented by any one of $R^{21}$ to $R^{23}$ include a halogen atom, an alkyl group, an aryl group, an alkoxy group, an amino group, an acyl group, an acylamino group, an alkylthio group, an arylthio group, a sulfonamido group, an acyloxy group, an oxycarbonyl group, a carbamoyl group, a sulfamoyl group, a sulfonyl group and a phosphoryl group. Of the groups, an alkyl group or an aryl group, for example, a methyl group, an ethyl group, an isopropyl group, a tert-butyl group, a tert-octyl group, a phenyl group, a 4-alkoxyphenyl group or a 4-acyloxyphenyl group, is preferred as the substituent.

Examples of the alkyl group for any one of $R^{21}$ to $R^{23}$ include a methyl group, an ethyl group, a butyl group, an octyl group, a dodecyl group, an isopropyl group, a tert-butyl group, a tert-amyl group, a tert-octyl group, a cyclohexyl group, a 1-methylcyclohexyl group, a benzyl group, a phenethyl group and a 2-phenoxypropyl group. Examples of the aryl group include a phenyl group, a cresyl group, a xylyl group, a naphthyl group, a 4-tert-butylphenyl group, a 4-tert-octylphenyl group, a 4-anisidyl group and a 3,5-dichlorophenyl group. Examples of the alkoxy group include a methoxy group, an ethoxy group, a butoxy group, an octyloxy group, a 2-ethylhexyloxy group, a 3,5,5-trimethylhexyloxy group, a dodecyloxy group, a cyclohexyloxy group, a 4-methylcyclohexyloxy group and a benzyloxy group. Examples of the aryloxy group include a phenoxy group, a cresyloxy group, an isopropylphenoxy group, a 4-tert-butylphenoxy group, a naphthoxy group and a biphenyloxy group. Examples of the amino group include a dimethylamino group, a diethylamino group, a dibutylamino group, a dioctylamino group, an N-methyl-N-hexylamino group, a dicyclohexylamino group, a diphenylamino group and an N-methyl-N-phenylamino group.

As each of $R^{21}$ to $R^{23}$, an alkyl group, an aryl group, an alkoxy group or an aryloxy group is preferred. From the viewpoint of effects achieved by the invention, it is preferred that at least one of $R^{21}$, $R^{22}$ and $R^{23}$ is an alkyl group or an aryl group, and it is more preferred that at least two of $R^{21}$, $R^{22}$ and $R^{23}$ are each an alkyl group or an aryl group. It is preferred that all of $R^{21}$, $R^{22}$ and $R^{23}$ are the same groups in view of availability of inexpensive compound.

Specific examples of the hydrogen bond-forming compound including the compound represented by formula (D) for use in the invention are set forth below, but the invention should not be construed as being limited thereto.

(D-1)

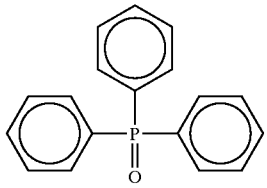

(D-2)

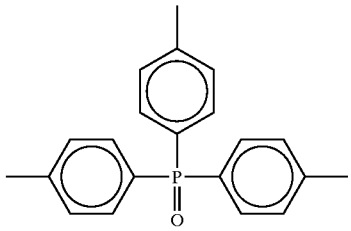

(D-3)

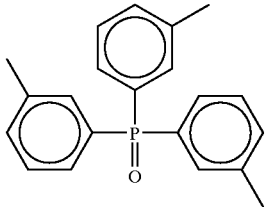

(D-4)

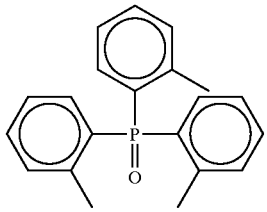

(D-5)

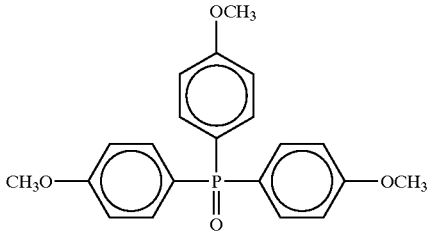

(D-6)

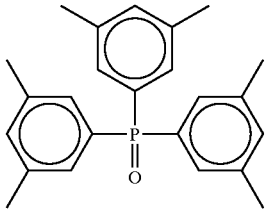

(D-7)

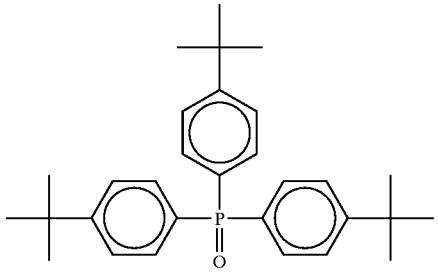

-continued (D-8)

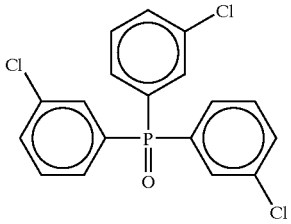

(D-9)

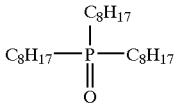

(D-10)

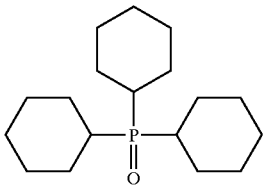

(D-11)

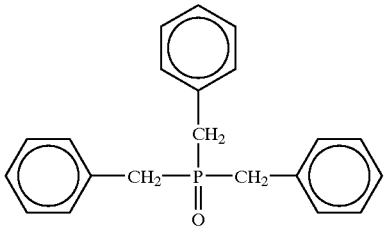

(D-12)

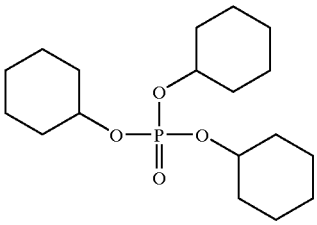

(D-13)

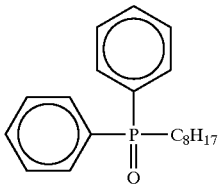

(D-14)

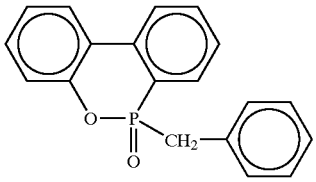

(D-15)

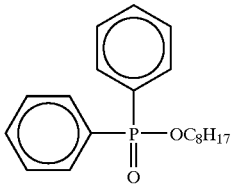

-continued (D-16)

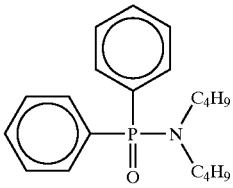

(D-17)

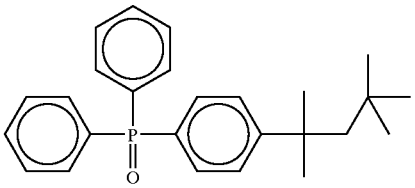

(D-18)

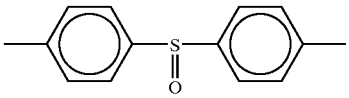

(D-19)

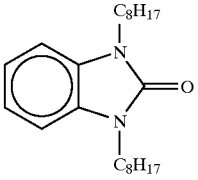

(D-20)

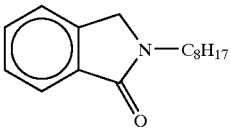

(D-21)

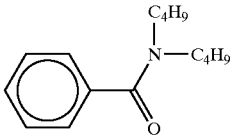

In addition to the compounds described above, examples of the hydrogen bond-forming compound include those described in European Patent 1,096,310 and JP-A-2002-156727 and JP-A-2002-318431.

The compound represented by formula (D) for use in the invention, similar to the case of the reducing agent, can be added to a coating solution in the form of a solution, an emulsified dispersion or a fine particulate solid dispersion, and incorporated into the photosensitive material. The compound is preferably used in the form of solid dispersion. When the compound is present in a solution, it forms a complex involving hydrogen bond with a compound containing a phenolic hydroxy group or an amino group. Depending on the combination of the reducing agent and the compound represented by formula (D) in the invention, the complex thereof can be isolated in a crystal state. The use of isolated crystal powder as a fine particulate solid dispersion is particularly preferred from the viewpoint of ensuring stable performances. It is also preferred to adopt a method in which powder of the reducing agent and powder of the compound represented by formula (D) are mixed and the resulting mixture is dispersed together with an appropriate dispersant using a device, for example, a sand grinder mill, thereby forming the complex thereof.

The compound represented by formula (D) is preferably used in an amount of from 1 to 200 mole %, more preferably from 10 to 150 mole %, and still more preferably from 20 to 100 mole %, based on the amount of reducing agent.

(Description of Silver Halide)

The light-sensitive silver halide for use in the invention has no particular restriction as to its halide composition, and any of silver chloride, silver chlorobromide, silver bromide, silver iodobromide, silver iodochlorobromide and silver iodide can be used. Of the silver halides, silver bromide and silver iodobromide are preferred. The halide distribution in the grain may be uniform, or may vary stepwise or continuously. Also, silver halide grain having a core/shell structure can be preferably used. As to the core/shell structure thereof, the core/shell grain of a two-layered to five-layered stricture is preferably used, and the core-shell grain of two-layered to four-layered structure is more preferably used. Further, techniques for localizing silver bromide or silver iodide on the grain surface of silver chloride, silver bromide or silver chlorobromide can be preferably used.

Methods for the formation of light-sensitive silver halide are well known in the field of art. For instance, the methods as described in *Research Disclosure*, No. 17029 (June, 1978) and U.S. Pat. No. 3,700,458 can be used. More specifically, the light-sensitive silver halide is prepared by adding a silver-supplying compound and a halogen-supplying compound to a gelatin or other polymer solution, and then mixed with the organic silver salt. It is also preferred to use the method as described in JP-A-11-119374, paragraphs [0217] to [0224] and the methods as described in JP-A-11-352627 and JP-A-2000-347335.

For the purpose of restraining white turbidity after the image formation, it is preferred that the grain size of light-sensitive silver halide is small. Specifically, the grain size is preferably not more than 0.20 $\mu$m more preferably from 0.01 $\mu$m to 0.15 $\mu$m, and still more preferably from 0.02 $\mu$m to 0.12 $\mu$m. The term "grain size" as used herein means a diameter of a circular image having an area equivalent to a projected area of silver halide grain (a projected area of the principal plane in the case of tabular grain).

Examples of a shape of the silver halide grain include cubic, octahedral, tabular, spherical, rod-like and potato-like shapes. In the invention, cubic grain is particularly preferred. Also, silver halide grain having rounded corners is preferably used. Although a plane index (Miller index) of the external surface of light-sensitive silver halide grain is not particularly limited, it is preferred that a proportion of {100} plane, which exhibits a high spectral sensitization efficiency when a spectral sensitizing dye adsorbs thereon, is high. The proportion of {100} plane is preferably not less than 50%, more preferably not less than 65%, and still more preferably not less than 80%. The proportion of Miller index {100} plane can be determined by the method described in T. Tani, *J. Imaging Sci.,* 29, 165 (1985), which utilizes adsorption dependence of sensitizing dye on {111} plane and {100} plane.

A silver halide grain on the outermost surface of which a hexacyano metal complex is present is preferably used in the invention. Examples of the hexacyano metal complex include $[Fe(CN)_6]^{4-}$, $[Fe(CN)_6]^{3-}$, $[Ru(CN)_6]^{4-}$, $[Os(CN)_6]^{4-}$, $[Co(CN)_6]^{3-}$, $[Rh(CN)_6]^{3-}$, $[Ir(CN)_6]^{3-}$, $[Cr(CN)_6]^{3-}$ and $[Re(CN)_6]^{3-}$. In the invention, the hexacyano iron complex is preferably used.

Since the hexacyano metal complex is present in the form of an ion in the aqueous solution thereof, a counter cation is of little importance. However, a cation easily miscible with water and suitable for the precipitation operation of silver halide emulsion, for example, an alkali metal ion, e.g., sodium ion, potassium ion, rubidium ion, cesium ion or lithium ion, an ammonium ion or an alkylammonium ion (e.g., tetramethylammonium ion, tetraethylammonium ion, tetrapropylammonium ion or tetra(n-butyl)ammonium ion) is preferably used.

The hexacyano metal complex can be added by dissolving in water or a mixed solvent of water and an appropriate organic solvent miscible with water (e.g., an alcohol, an ether, a glycol, a ketone, an ester or an amide), or mixing with gelatin.

The amount of hexacyano metal complex added is preferably from $1\times10^{-5}$ mole to $1\times10^{-2}$ mole, and more preferably from $1\times10^{-4}$ mole to $1\times10^{-3}$ mole, per mole of silver.

In order to make the hexacyano metal complex be present on the outermost surface of silver halide grain, the hexacyano metal complex is directly added after the completion of the addition of an aqueous silver nitrate solution used for grain formation and before the completion of the preparation process, specifically, before a chemical sensitization process, in which chalcogen sensitization, for example, sulfur sensitization, selenium sensitization or tellurium sensitization, or noble metal sensitization, for example, gold sensitization is carried out, or during a washing process, a dispersion process or the chemical sensitization process. In order to inhibit the growth of fine silver halide grain, it is preferred to add the hexacyano metal complex after the grain formation without delay and before the completion of the preparation process.

The addition of hexacyano metal complex preferably starts after the addition of 96 weight % of the total amount of silver nitrate to be added for the grain formation, more preferably after the addition of 98 weight % of the total amount of silver nitrate to be added for the grain formation, and particularly preferably after the addition of 99 weight % of the total amount of silver nitrate to be added for the grain formation.

When the hexacyano metal complex is added after the addition of an aqueous silver nitrate solution immediately before the completion of grain formation, the complex can adsorb onto the outermost surface of silver halide grain, and mostly form sparingly soluble salt together with silver ion present on the grain surface. Since the silver salt of hexacyano iron (II) is less soluble than AgI, the redissolution due to fine grain can be prevented and the production of silver halide grain having a small grain size is possible.

The light-sensitive silver halide grain of the invention can contain metal belonging to Groups VIII to X of the periodic table (listing elements of Groups I to XVIII) or a complex thereof. The metal or central metal of the metal complex belonging to Groups VIII to X of the periodic table preferably includes rhodium, ruthenium and iridium. The metal complexes may be used individually, or as a combination of two or more complexes having metals of the same kind or different kinds. The suitable content of the metal or metal complex is from $1\times10^{-9}$ to $1\times10^{-3}$ mole per mole of silver. The heavy metal, the complex thereof and the addition methods thereof are described in JP-A-7-225449, JP-A-11-65021, paragraphs [0018] to [0024], and JP-A-11-119374, paragraphs [0227] to [0240].

Further, metal atoms and metal complexes (e.g., $[Fe(CN)_6]^{-4}$), which can be incorporated into the silver halide grain for use in the invention, and desalting methods and chemical sensitization methods of silver halide emulsion for use in the invention are described in JP-A-11-84574, paragraphs [0046] to [0050], JP-A-11-65021, paragraphs [0025] to [0031], and JP-A-11-119374, paragraphs [0242] to [0250].

Various gelatins can be used in the light-sensitive silver halide emulsion for use in the invention. In order to maintain the dispersion state of light-sensitive silver halide emulsion in a coating solution containing the organic silver salt in a good condition, it is preferred to use gelatin having a molecular weight of from 10,000 to 1,000,000. Modified gelatin, for example, gelatin whose substituent is subjected to phthalation treatment is also preferably used. The gelatin may be used at the time of grain formation or dispersion after the desalting step. Preferably, it is used at the time of grain formation.

As the sensitizing dye for use in the invention, a sensitizing dye capable of spectrally sensitizing silver halide grain in the desired wavelength region when it is adsorbed to the silver halide grain and having spectral sensitivity suitable for a spectral characteristic of an exposure light source can be advantageously selected. Examples of the sensitizing dye and method for the addition thereof include those described in JP-A-11-65021, paragraphs [0103] to [0109], the compounds represented by formula (II) described in JP-A-10-186572, the dyes represented by formula (I) and described in paragraph [0106] of JP-A-11-119374, the dyes described in U.S. Pat. No. 5,510,236, the dyes described in Example 5 of U.S. Pat. No. 3,871,887, the dyes described in JP-A-2-96131, the dyes described in JP-A-59-48753, the dyes described in EP-A-803764, from page 19, line 38 to page 20, line 35, and the dyes described in JP-A-2001-272747, JP-A-2001-290238 and 2002-23306. The sensitizing dyes may be used individually or in combination of two or more thereof. In the invention, a period of adding the sensitizing dye to the silver halide emulsion is preferably after the desalting step and before coating and more preferably after the desalting step and before the completion of the chemical ripening.

The amount of the sensitizing dye added in the invention is appropriately determined considering the desired performances, for example, sensitivity and fog. Specifically, the amount thereof is preferably from $10^{-6}$ to 1 mole, and more preferably from $10^{-4}$ to $10^{-1}$ mole, per mole of silver halide in the light-sensitive layer.

For the purpose of enhancing the spectral sensitization efficiency, a super sensitizer can be used. Examples of the super sensitizer for use in the invention include the compounds described in EP-A-587338, U.S. Pat. Nos. 3,877,943 and 4,873,184, JP-A-5-341432, JP-A-11-109547 and JP-A-10-111543.

It is preferred that the light-sensitive silver halide grain for use in the invention is chemically sensitized according to a chalcogen sensitization method, for example, a sulfur sensitization method, a selenium sensitization method or a tellurium sensitization method. The compounds preferably used in the sulfur, selenium and tellurium sensitization methods include known compounds, for example, the compounds described in JP-A-7-128768. In the invention, the tellurium sensitization is particularly preferred. For the tellurium sensitization, the compounds described in the references cited in JP-A-11-65021, paragraph [0030], and the compounds represented by formulae (II), (III) and (IV) in JP-A-5-313284 are preferably used.

It is preferred that the light-sensitive silver halide grain for use in the invention is chemically sensitized according to a gold sensitization method individually or in combination with the chalcogen sensitization method. As gold sensitizers, compounds containing +1 valent or +3 valent gold are preferred and conventionally used gold compounds are preferably employed. Representative preferred examples of the gold sensitizer include chlorauric acid, bromauric acid, potassium chloraurate, potassium bromaurate, auric trichloride, potassium auricthiocyanate, potassium iodaurate, tetracyanoauric acid, ammonium aurothiocyanate and pyridyl trichlorogold. The gold sensitizers described in U.S. Pat. No. 5,858,637 and JP-A-2002-278016 are also preferably used.

In the invention, chemical sensitization can be performed at any time within a period between the completion of grain formation and the start of coating, specifically after the desalting, (1) before the spectral sensitization, (2) simultaneously with the spectral sensitization, (3) after the spectral sensitization, or (4) immediately before the coating.

The amount of sulfur, selenium and tellurium sensitizers used in the invention may vary depending on the silver halide grain used and chemical ripening conditions. Specifically, the amount used is in the order of from $10^{-8}$ to $10^{-2}$ mole, and preferably from $10^{-7}$ to $10^{-3}$ mole, per mole of silver halide.

The amount of gold sensitizer used in the invention may vary depending on various conditions. As an indication of the addition, the amount is from $10^{-7}$ to $10^{-3}$ mole, and preferably from $10^{-6}$ to $5\times10^{-4}$ mole, per mole of silver halide.

The conditions for chemical sensitization are not particularly restricted. Ordinarily, the pH is from 5 to 8, the pAg is from 6 to 11 and the temperature is from 40 to 95° C.

To the silver halide emulsion for use in the invention, a thiosulfonic acid compound may be added according to the method described in EP-A-293917.

The light-sensitive silver halide grain for use in the invention is preferably subjected to reduction sensitization. Preferred examples of compound for use in the reduction sensitization method include ascorbic acid and thiourea dioxide. Further, stannous chloride, aminoimonomethanesulfinic acid, a hydrazine derivative, a boran compound, a silane compound or a polyamine compound is preferably used. The addition of reduction sensitizer can be performed at any step of the production of light-sensitive emulsion including from the growth of crystal to just before the coating step. The reduction sensitization is preferably carried out by ripening while maintaining pH of the emulsion at 7 or above or pAg of the emulsion at 8.3 or below. It is also preferred to conduct the reduction sensitization by introducing a singe addition part of silver ion during the grain formation.

The light-sensitive silver halide emulsion for use in the invention preferably contains an FED sensitizer (fragmentable electron donating sensitizer), which generates two electrons per photon. As the FED sensitizer, the compounds described in U.S. Pat. Nos. 5,747,235, 5,747,236, 6,054,260 and 5,994,051 and JP-A-2002-287293 are preferably used. The addition of FED sensitizer can be performed at any step of the production of light-sensitive emulsion including from the growth of crystal to just before the coating step. The amount of FED sensitizer added may vary depending on various conditions. As an indication of the addition, the amount is from $10^{-7}$ to $10^{-1}$ mole, preferably from $10^{-6}$ to $5\times10^{-2}$ mole, per mole of silver halide.

In the photosensitive material of the invention, only one kind of light-sensitive silver halide emulsion may be used, or two or more kinds of light-sensitive silver halide emulsions (differing in average grain size, halide composition, crystal habit or condition for chemical sensitization) may be used in combination. The use of plural light-sensitive silver halide emulsions differing in sensitivity enables gradation control. Such techniques are described, e.g., in JP-A-57-119341, JP-A-53-106125, JP-A-47-3929, JP-A-48-55730, JP-A-46-5187, JP-A-50-73627 and JP-A-57-150841. As to the sensitivity difference, it is preferred that the sensitivities of emulsions are different from each other by at least 0.2 in terms of Log E.

The amount of light-sensitive silver halide added is preferably from 0.03 to 0.6 g/m$^2$, more preferably from 0.05 to 0.4 g/m$^2$, and most preferably from 0.07 to 0.3 g/m$^2$, in the amount of silver coated per m$^2$ of photosensitive material. A ratio of the light-sensitive silver halide to the organic silver salt is preferably from 0.01 to 0.5 mole, more preferably from 0.02 to 0.3 more, and still more preferably from 0.03 to 0.2 mole, per mole of the organic silver salt.

With respect to the method and condition for mixing light-sensitive silver halide and organic silver salt prepared separately, there are known the method of mixing the silver halide grain prepared and the organic silver salt prepared by means of a high-speed stirrer, a ball mill, a sand mill, a colloid mill, a vibration mill or a homogenizer, and the method of preparing an organic silver salt wherein the light-sensitive silver halide prepared is mixed at any timing during the preparation of organic silver salt. However, no particular restriction is imposed thereon so far as the present effects can be sufficiently produced. For controlling photographic characteristics, it is preferred to mix aqueous dispersions of two or more organic silver salts with aqueous dispersions of two or more light-sensitive silver salts.

The suitable timing at which the silver halide of the invention is added to a coating solution for light-sensitive layer is from 180 minutes before to just before the start of coating, and preferably from 60 minutes to 10 seconds before the start of coating. There are no particular restrictions on the method and condition for mixing the silver halide with the coating solution so far as the effects of the invention can be sufficiently achieved. Specific examples of the mixing method include a mixing method using a tank controlled so that the average stay time calculated from the rate of liquid flow added to the tank and the volume of the liquid sent into a coater becomes the desired value, and a method of using a static mixer as described in N. Harnby, M. F. Edwards and A. W. Nienow, *Ekitai Kongou Gijutsu* (translated by Koji Takahashi), Chapter 8, The Nikkan Kogyo Shimbun, Ltd. (1989).

(Description of Binder)

As the binder for the organic silver salt-containing layer of the invention, any polymer may be used. Examples of the binder preferably used include transparent or translucent, ordinarily colorless, natural resins, polymers and copolymers, synthetic resins, polymers and copolymers, and other film-forming media, for example, gelatin, rubber, polyvinyl alcohol, hydroxyethyl cellulose, cellulose acetate, cellulose acetate butyrate, polyvinyl pyrrolidone, casein, starch, polyacrylic acid, polymethyl methacrylate, polyvinyl chloride, polymethacrylic acid, styrene-maleic anhydride copolymer, styrene-acrylonitrile copolymer, styrene-butadiene copolymer, polyvinyl acetal (for example, polyvinyl formal or polyvinyl butyral), polyester, polyurethane, phenoxy resin, polyvinylidene chloride, polyepoxide, polycarbonate, polyvinyl acetate, polyolefin, cellulose ester and polyamide. The binder may form a coating film through the use of water, an organic solvent or an emulsion.

The glass transition temperature (Tg) of binder for use in the organic silver salt-containing layer is preferably from 0° C. to 80° C. (hereinafter, the binder having its glass transition temperature in such a temperature range is also referred to as a high Tg binder sometimes), more preferably from 10° C. to 70° C., and still more preferably from 15° C. to 60° C.

In the specification, the Tg of a polymer is calculated according to the following equation:

$$1/Tg=\Sigma(Xi/Tgi)$$

wherein, assuming that the polymer is a copolymer composed of n monomers from i=1 to i=n, Xi is a weight fraction of the ith monomer ($\Sigma Xi=1$) and Tgi is a glass transition temperature (measured in absolute temperature) of a homopolymer formed from the ith monomer. The symbol $\Sigma$ means the sum of i=1 to i=n. The value of the glass transition temperature of a homopolymer formed from each monomer (Tgi) is adopted from J. Brandrup and E. H. Immergut, *Polymer Handbook,* 3rd. Edition, Wiley-Interscience (1989).

Two or more binders may be used in combination, if desired. Further, a binder having a glass transition temperature of not lower than 20° C. and a binder having a glass transition temperature lower than 20° C. may be used in combination. When two or more polymers differing in Tg are used in combination, it is preferred that a weight average Tg is within the above-described range.

In the invention, it is preferable that the organic silver salt-containing layer is formed by applying a coating solution wherein water constitutes at least 30 weight % of the solvent thereof and drying to form a film.

In the invention, improved performances can be achieved when the organic silver salt-containing layer is formed by applying and drying a coating solution containing water in a proportion of at least 30 weight % based on the total amount of solvent used, further when the binder used in the organic silver salt-containing layer can be dissolved or dispersed in a water-based solvent (aqueous solvent), and particularly when a binder comprising a latex of polymer having an equilibrium moisture content of 2 weight % or below under conditions of 25° C. and 60% RH. According to the most preferable form, the organic silver salt-containing layer is prepared so as to have an ionic conductivity of 2.5 mS/cm or below. The preparation method thereof includes purifying a polymer using an isolation membrane after the synthesis thereof.

The water-based solvent, in which a binder can be dissolved or dispersed, includes water and a mixture of water and not more than 70 weight % of a water-miscible organic solvent. Examples of the water-miscible organic solvent include an alcohol solvent, for example, methyl alcohol, ethyl alcohol or propyl alcohol, a cellosolve solvent, for example, methyl cellosolve, ethyl cellosolve or butyl cellosolve, ethyl acetate and dimethylformamide.

The water-based solvent is also used for a solvent in which the polymer is not dissolved thermodynamically but present in a so-called dispersed state.

The equilibrium moisture content under conditions of 25° C. and 60% RH can be described by the following equation using the weight of a polymer in a moisturized equilibrium under the 25° C. and 60% RH atmosphere, W1, and the weight of the polymer in an absolutely dried state at 25° C., W0:

Equilibrium moisture content under 25° C. and 60% $RH=\{(W1-W0)/W0\}\times 100$ (by weight %)

Regarding the definition of the moisture content and the method for measuring thereof, e.g., Koubunshi Gakkai ed., Koubunshi Kougaku Kouza, 14th volume, *Kobunshi Zairyo Shikenho*, Chijinshokan can be referred to.

The equilibrium moisture content of the binder polymer under conditions of 25° C. and 60% RH is preferably 2 weight % or below, more preferably from 0.01 to 1.5 weight %, and still more preferably from 0.02 to 1 weight %.

In the invention, a polymer dispersible in the water-based solvent is particularly preferable. Examples of the polymer in a dispersed state include a latex in which fine particles of a water-insoluble, hydrophobic polymer are dispersed, and a dispersion in which a polymer molecule is dispersed in a molecular state or in the form of micelle. Particles dispersed in the latex form are preferable. The average diameter of dispersed particles is from 1 to 50,000 nm, preferably from 5 to 1,000 nm, more preferably from 10 to 500 nm, and still more preferably from 50 to 200 nm. The diameter distribution of dispersed particles is not particularly restricted, and both broad particle diameter distribution and monodisperse particle diameter distribution may be used. A mixture of two or more polymers each having the monodisperse particle diameter distribution is also advantageous from the viewpoint of controlling physical properties of the coating solution.

Preferred examples of the polymer dispersible in a water-based solvent for use in the invention include a hydrophobic polymer, for example, acrylic polymer, polyester, rubber (e.g., SBR resin), polyurethane, polyvinyl chloride, polyvinyl acetate, polyvinylidene chloride and polyolefin. The polymer may be a linear, branched or cross-linked polymer, and it may be a polymer obtained by polymerization of single sort monomer, namely a so-called homopolymer, or a copolymer obtained by polymerization of two or more sorts of monomers. In the case of copolymer, both random and block copolymers are usable. The number average molecular weight of the polymer is preferably from 5,000 to 1,000,000, and more preferably from 10,000 to 200,000. When the molecular weight is too low, the mechanical strength of the light-sensitive layer formed becomes insufficient, while too high molecular weight is also undesirable because of poor film formability. In particular, cross-linking polymer latex is preferably used.

(Specific Examples of Latex)

Preferred examples of the polymer latex are recited below. In the following examples, each latex is represented by monomers as starting materials, each figure in parentheses is expressed in weight %, and "molecular weight" means a number average molecular weight. When polyfunctional monomer is used, the concept of molecular weight cannot be applied because a cross-linked structure is formed. Therefore, such a latex is described as cross-linking and its molecular weight description is omitted. "Tg" stands for a glass transition temperature.

P-1; -MMA(70)-EA(27)-MAA(3)- latex (molecular weight: 37,000, Tg: 61° C.)

P-2; -MMA(70)-2EHA(20)-St(5)-AA(5)- latex (molecular weight: 40,000, Tg: 59° C.)

P-3; -St(50)-Bu(47)-MAA(3)- latex (cross-linking, Tg: −17° C.)

P-4; -St(68)-Bu(29)-AA(3)- latex (cross-linking, Tg: 17° C.)

P-5; -St(71)-Bu(26)-AA(3)- latex (cross-linking, Tg: 24° C.)

P-6; -St(70)-Bu(27)-IA(3)- latex (cross-linking)

P-7; -St(75)-Bu(24)-AA(1)- latex (cross-linking, Tg: 29° C.)

P-8; -St(60)-Bu(35)-DVB(3)-MAA(2) latex (cross-linking)

P-9; -St(70)-Bu(25)-DVB(2)-AA(3)- latex (cross-linking)

P-10: -VC(50)-MMA(20)-EA(20)-AN(5)-AA(5)- latex (molecular weight: 80,000)

P-11; -VDC(85)-MMA(5)-EA(5)-MAA(5)- latex (molecular weight: 67,000)

P-12; -Et(90)-MAA(10)- latex (molecular weight:12,000)

P-13; -St(70)-2EHA(27)-AA(3)- latex (molecular weight: 130,000, Tg: 43° C.)

P-14; -MMA(63)-EA(35)-AA(2)- latex (molecular weight: 33,000, Tg: 47° C.)

P-15; -St(70.5)-Bu(26.5)-AA(3)- latex (cross-linking, Tg: 23° C.) P-16; -St(69.5)-Bu(27.5)-AA(3)- latex (cross-linking, Tg: 20.5° C.)

The abbreviations In the above formulae stand for the following monomers respectively: MMA; methyl methacrylate, EA: ethyl acrylate, MAA; methacrylic acid, 2EHA; 2-ethylhexyl acrylate, St; styrene, Bu; butadiene, AA; acrylic acid, DVB; divinylbenzene, VC; vinyl chloride, AN; acrylonitrile, VDC; vinylidene chloride, Et; ethylene, IA; itaconic acid.

The polymer latices described above are also commercially available, and the following products can be used. Examples of acrylic polymer products include Sebian A-4635, 4718 and 4601 (produced by Daicel Chemical industries, Ltd.), and Nipol Lx811, 814, 821, 820 and 857 (produced by Zeon Corp.). Examples of polyester products include FINETEX ES650, 611, 675 and 850 (produced by Dainippon Ink and Chemicals, Inc.), and WD-size and WMS (produced by Eastman Chemical). Examples of polyurethane products include HYDRAN AP10, 20, 30 and 40 (produced by Dainippon Ink and Chemicals, Inc.). Examples of rubber products include LACSTAR 7310K, 3307B, 4700H and 7132C (produced by Dainippon Ink and Chemicals, Inc.), and Nipol Lx416, 410, 438C and 2507 (produced by Zeon Corp.). Examples of polyvinyl chloride products include G351 and G576 (produced by Zeon Corp.). Examples of polyvinylidene chloride products include L502 and L513 (produced by Asahi Kasei Corporation). Examples of polyolefin products include Chemipearl S120 and SA100 (produced by Mitsui Chemicals, Inc.).

The polymer latices may be used individually or as a mixture of two or more thereof, if desired.

(Preferred Latex)

As the polymer latex for use in the invention, styrene-butadiene copolymer latex is preferred in particular. The ratio between styrene unit and butadiene unit in the styrene-butadiene copolymer is preferably from 40:60 to 95:5 by weight. Also, it is preferred that the total amount of styrene unit and butadiene unit is from 60 to 99 weight % of the copolymer. Further, the polymer latex preferably contains acrylic acid unit or methacrylic acid unit in an amount of from 1 to 6 weight %, and more preferably from 2 to 5 weight %, based on the sum total of styrene and butadiene units. The incorporation of acrylic acid unit into the polymer latex is preferred.

Examples of styrene-butadiene-acid copolymer latex preferably used in the invention include the foregoing P-3 to P-9, P-15 and P-16, and LACSTAR-3307S, LACSTAR-7132C and Nipol Lx416 as the commercial products.

To the organic silver salt-containing layer of the photosensitive material according to the invention may be added a hydrophilic polymer, for example, gelatin, polyvinyl alcohol, methyl cellulose, hydroxypropyl cellulose or carboxymethyl cellulose, if desired. The amount of hydrophilic polymer added is preferably not more than 30 weight %, and more preferably not more than 20 weight %, based on the total binder in the organic silver salt-containing layer.

It is preferable that the organic silver salt-containing layer (i.e., the image-forming layer) is a layer formed using a polymer latex. The ratio of the total binder to the organic silver salt in the organic silver salt-containing layer is preferably from 1/10 to 10/1, more preferably from 1/3 to 5/1, and still more preferably from 1/1 to 1/3, by weight.

Ordinarily, the organic silver salt-containing layer is also a light-sensitive layer (an emulsion layer) containing light-sensitive silver halide, which is a light-sensitive silver salt. In such a case, the ratio of the total binder to the silver halide is preferably from 400/1 to 5/1, and more preferably from 200/1 to 10/1, by weight.

The amount of total binder contained in the image-forming layer is preferably from 0.2 to 30 gim$^2$, more preferably from 1 to 15 g/m$^2$, and still more preferably from 2 to 10 g/m$^2$. To the image-forming layer may be added a cross-linking agent for crosslinking and a surfactant for improving coating property.

(Description of Preferable Solvent for Coating Solution)

The solvent (herein, a solvent and a dispersing medium are both referred to as a solvent for simplicity's sake) suitably used in a coating solution for the organic silver salt-containing layer of the photosensitive material of the invention is a water-based solvent containing at least 30 weight % water. As a solvent component other than water, an appropriate water-miscible organic solvent, for example, methyl alcohol, ethyl alcohol, isopropyl alcohol, methyl cellosolve, ethyl cellosolve, dimethylformamide or ethyl acetate, may be used. The water content in the solvent for the coating solution is preferably at least 50 weight %, and more preferably at least 70 weight %. Preferred examples of the solvent composition include water=100, water/methyl alcohol=90/10, water/methyl alcohol=70/30, ater/methyl alcohol/dimethylformamide=80/15/5, water/methyl alcohol/ethyl cellosolve=85/10/5, and water/methyl alcohol/isopropyl alcohol=85/10/5 (wherein all the figures are by weight %).

(Description of Antifoggant)

The compounds described in JP-A-10-62899, paragraph [0070], the compounds described in EP-A-803764, page 20, line 57 to page 21, line 7, the compounds described in JP-A-9-281637 and JP-A-9-329864, the compounds described in U.S. Pat. No. 6,083,681 and European Patent 1048975 can be used as an antifoggant, stabilizer and precursor of stabilizer in the invention. In addition, the antifoggant preferably used in the invention is an organic halogen compound. Examples of the organic halogen compound include the compounds described in JP-A-11-65021, paragraphs [0111] and [0112]. In particular, the organic halogen compounds represented by formula (P) in JP-A-2000-284399, the organic polyhalogen compounds represented by formula (II) in JP-A-10-339934, and the organic polyhalogen compounds described in JP-A-2001-31644 and JP-A-2001-33911 are preferred.

(Description of Polyhalogen Compound)

Organic polyhalogen compound preferably used in the invention will be described in detail below.

The polyhalogen compound preferably used in the invention includes a compound represented by the following formula (H):

$$Q—(Y)_n—C(Z_1)(Z_2)X \quad (H)$$

In formula (H), Q represents an alkyl group, an aryl group or a heterocyclic group, Y represents a divalent connecting group, n represents 0 or 1, $Z_1$ and $Z_2$ each represent a halogen atom, and X represents a hydrogen atom or an electron withdrawing group In formula (H), Q preferably represents an aryl group or a heterocyclic group. When Q represents a heterocyclic group in formula (H), a nitrogen-containing heterocyclic group having one or two nitrogen atoms is preferred, and a 2-pyridyl group or a 2-quinolyl group is particularly preferred.

When Q represents an aryl group in formula (H), Q is preferably a phenyl group substituted with an electron withdrawing group having a positive value of Hammett's substituent constant σp. With respect to the Hammett's substituent constant, *Journal of Medicinal Chemistry*, Vol. 16, No. 11, pages 1207–1216 (1973) can be referred to. Examples of the electron withdrawing group include a halogen atom (e.g., fluorine (σp value: 0.06), chlorine (σp value: 0.23), bromine (σp value: 0.23), iodine (σp value: 0.18)), a trihalomethyl group (e.g., tribromomethyl (σp value: 0.29), trichloromethyl (σp value: 0.33), trifluoromethyl (σp value: 0.54)), a cyano group (σp value: 0.66), a nitro group (σp value: 0.78), an aliphatic, aryl or heterocyclic sulfonyl group (e.g., methanesulfonyl (σp value: 0.72), an aliphatic, aryl or heterocyclic acyl group (e.g., acetyl (σp value: 0.50), benzoyl (σp value: 0.43)), an alkynyl group (e.g., —C≡CH (σp value: 0.23)), an aliphatic, aryl or heterocyclic oxycarbonyl group (e.g., methoxycarbonyl (σp value: 0.45)), phenoxycarbonyl (σp value: 0.44)), a carbamoyl group (σp value: 0.36), a sulfamoyl group (σp value: 0.57), a sulfoxido group, a heterocyclic group and a phosphoryl group. The σp value is preferably in the range of from 0.2 to 2.0, and more preferably from 0.4 to 1.0. Particularly preferred examples of the electron withdrawing group include a carbamoyl group, an alkoxycarbonyl group, an alkylsulfonyl group and an alkylphosphoryl group. Of these groups, a carbamoyl group is most preferred.

In formula (H), X is preferably an electron withdrawing group, more preferably a halogen atom, an aliphatic, aryl or heterocyclic sulfonyl group, an aliphatic, aryl or heterocyclic acyl group, an aliphatic, aryl or heterocyclic oxycarbonyl group, a carbamoyl group or a sulfamoyl group, and particularly preferably a halogen atom. Of the halogen atoms, a chlorine atom, a bromine atom or an iodine atom is preferred, a chlorine atom or a bromine atom is more preferred, and a bromine atom is particularly preferred.

Y is preferably —C(=O)—, —SO— or —$SO_2$—, more preferably —C(=O)— or —$SO_2$—, and particularly preferably —$SO_2$—.

n is 0 or 1, and preferably 1.

Specific examples of the compound represented by formulae (H) are set forth below, but the invention should not be construed as being limited thereto.

(H-1)

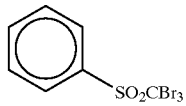

(H-2)

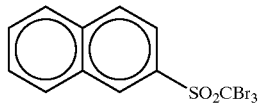

(H-3)

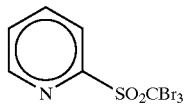

(H-4)

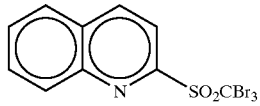

(H-5)

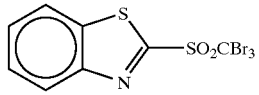

(H-6)

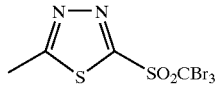

-continued
(H-7)
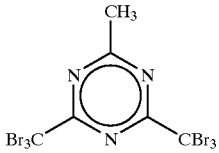
(H-8)
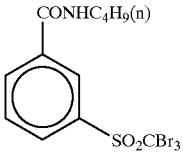
(H-9)
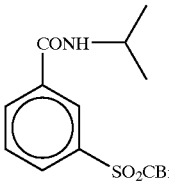
(H-10)
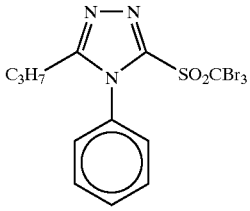
(H-11)
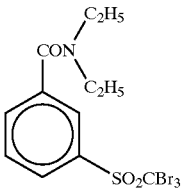
(H-12)
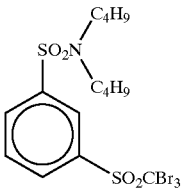
(H-13)
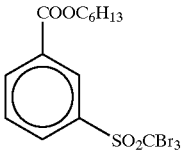
(H-14)
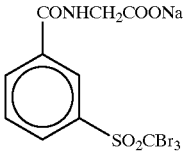
(H-15)
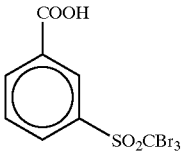
-continued
(H-16)
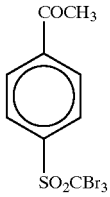
(H-17)
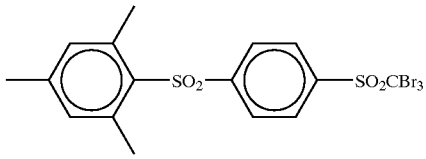
(H-18)
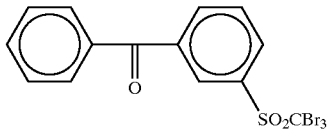
(H-19)
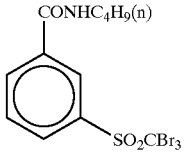
(H-20)
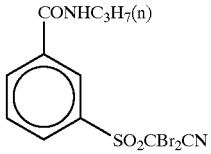
(H-21)
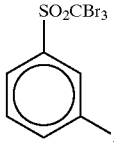
(H-22)
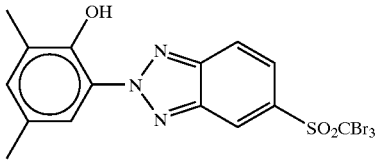
(H-23)
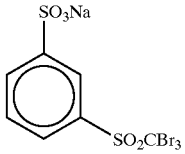
(H-24)
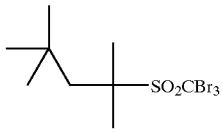
The antifoggant according to the invention, preferably the compound represented by formula (H) is used preferably in an amount of from $10^{-4}$ to 1 mole, more preferably from $10^{-3}$ to 0.5 moles, and still more preferably from $1\times10^{-2}$ to 0.2 moles, per mole of the light-insensitive silver salt in the image-forming layer.

As a method of incorporating the antifoggant into the photosensitive material of the invention, the methods as described above for the reducing agent can be employed. Specifically, the method of adding in the form of a fine particulate solid dispersion is also preferable for the organic polyhalogen compound.

(Other Antifoggants)

Examples of other antifoggants include the mercury(II) salts described in JP-A-11-65021, paragraph [0113], the benzoic acids described in JP-A-11-65021, paragraph [0114], the salicylic acid derivatives described in JP-A-2000-206642, the formaldehyde scavenger compounds represented by formula (S) in JP-A-2000-221634, the triazine compounds described in claim 9 of JP-A-11-352624, the compounds represented by formula (III) in JP-A-6-11791 and 4-hydroxy-6-methyl-1,3,3a,7-tetraazaindene.

The heat-developable photosensitive material of the invention may contain an azolium salt for the purpose of preventing fog. Examples of the azolium salt include the compounds represented by formula (XI) described in JP-A-59-193447, the compounds described in JP-B-55-12581, and the compounds represented by formula (II) described in JP-A-60-153039. The azolium salt, though may be added to any region of the photosensitive material, is preferably added to a layer present on the light-sensitive layer side. More preferably, it is added to the organic silver salt-containing layer. The addition of azolium salt may be carried out at any step in the preparation of a coating solution. In the case of adding it to the organic silver salt-containing layer, the addition timing may be any step in the process from organic silver salt preparation to coating solution preparation, but preferably during the period from the completion of organic silver salt preparation to just before the coating. The azolium salt may be added by any method, such as a method of adding in the form of powder, a solution or a fine particulate dispersion. It may also be added as a solution of a mixture with other additives, for example, a sensitizing dye, a reducing agent or a toning agent. The amount of azolium salt added in the invention, though may be any value, is preferably from $1\times10^{-6}$ to 2 moles, and more preferably from $1\times10^{-3}$ to 0.5 moles, per mole of silver.

Into the photosensitive material of the invention, a mercapto compound, disulfide compound or thione compound can be incorporated for the purposes of controlling the development through retardation or acceleration, enhancing the efficiency of spectral sensitization and improving the preservability before and after the development. Examples of the compounds include the compounds described in JP-A-10-62899, paragraphs [0067] to [0069], the compounds represented by formula (I) in JP-A-10-186572 and specific examples thereof described in paragraphs [0033] to [0052], and the compounds described in EP-A-803764, page 20, lines 36 to 56. Of the compounds, the mercapto-substituted aromatic heterocyclic compounds as described in JP-A-9-297367, JP-A-9-304875, JP-A-2001-100358, JP-A-2002-303954 and JP-A-2002-303951 are preferable.

(Description of Toning Agent)

Addition of toning agent is preferable for the heat-developable photosensitive material of the invention. Descriptions of the toning agent can be found in JP-A-10-62899, paragraphs [0054] and [0055], EP-A-803764, page 21, lines 23 to 48, JP-A-2000-356317 and JP-A-2000-187298. Particularly, a phthalazinone (phthalazinone, a derivative or metal salt thereof, e.g., 4-(1-naphthyl) phthalazinone, 6-chlorophthalazinone, 5,7-dimethoxyphthalazinone or 2,3-dihydro-1,4-phthalazinedione), a combination of a phthalazinone and a phthalic acid(e.g., phthalic acid, 4-methylphthalic acid, 4-nitrophthalic acid, diammonium phthalate, sodium phthalate, potassium phthalate or tetrachlorophthalic anhydride), a phthalazine (phthalazine, a derivative or metal salt thereof, e.g., 4-(1-naphthyl)phthalazine, 6-isopropylphthalazine, 6-tert-butylphthalazine, 6-chlorophthalazine, 5,7-dimethoxyphthalazine or 2,3-dihydrophthalazine) and a combination of a phthalazine and a phthalic acid are preferably used, and the combination of a phthalazine and a phthalic acid is more preferably used. In particular, the combination of 6-isopropylphthalazine and phthalic acid or 4-methylphthalic acid is preferred.

(Description of Other Additives)

A plasticizer and lubricant for use in the light-sensitive layer of the invention are described in JP-A-11-65021, paragraph [0117]. The super high contrast imparting agent for formation of super high contrast images and the addition method and amount thereof for use in the light-sensitive layer of the invention are described in JP-A-2000-65021, paragraph [0118], JP-A-11-223898, paragraphs [0136] to [01931]. Examples thereof further include the compounds represented by formula (H), formulae (1) to (3), and formulae (A) and (B) respectively in JP-A-2000-284399 and the compounds represented by formulae (III) to (V) (specifically, Compounds of [Ka-21] to [Ka-24]) in JP-A-2000-347345. The high contrast accelerating agent, which can be used in the light-sensitive layer of the invention, includes those described in JP-A-11-65021, paragraph [0102], and JP-A-11-223898, paragraphs [0194] and [0195].

In order that formic acid or a salt thereof serves as a strong fogging substance, it is preferably used in an amount of not more than 5 millimoles, and more preferably not more than 1 millimole, per mole of silver on the side where the image-forming layer containing light-sensitive silver halide is present.

When the super high contrast imparting agent is used in the heat-developable photosensitive material of the invention, it is preferable to use an acid formed by hydration of diphosphorus pentoxide or a salt thereof in combination therewith. Examples of the acid formed by hydration of diphosphorus pentoxide and salt thereof include metaphosphoric acid (metaphosphate), pyrophosphoric acid (pyrophosphate), orthophosphoric acid (orthophosophate), triphosphoric acid (triphosphate), tetraphosphoric acid (tetraphosphate), and hexametaphosphoric acid (hexametaphosphate). Of the acids formed by hydration of diphosphorus pentoxide and salts thereof, orthophosphoric acid (orthophosphate) and hexametaphosphoric acid (hexametaphosphate) are particularly preferably used. Specific examples of the salt include sodium orthophosphate, sodium dihydrogen orthophosphate, sodium hexametaphosphate and ammonium hexametaphosphate.

The amount of the acid formed by hydration of diphosphorus pentoxide or salt thereof (coating coverage per $m^2$ of the photosensitive material) may be appropriately determined considering the characteristics such as sensitivity and fog. Specifically, the amount is preferably from 0.1 to 500 $mg/m^2$, and more preferably from 0.5 to 100 $mg/m^2$.

(Description of Layer Structure)

The heat-developable photosensitive material of the invention can have a surface protective layer for the purpose of preventing adhesion of the image-forming layer. The surface protective layer may be a single layer or a multiple layer. Descriptions of the surface protective layer can be found in JP-A-11-65021, paragraphs [0119] and [0120], and JP-A-2000-171936.

As a binder for the surface protective layer of the invention, gelatin is preferably used. It is also preferred to use polyvinyl alcohol (PVA) alone or in combination with gelatin. As to the gelatin used, inert gelatin (e.g. Nitta Gelatin 750) and phthalated gelatin (e.g., Nitta Gelatin 801) can be used. Examples of PVA used include those described in JP-A-2000-171936, paragraphs [0009] to [0020], preferably PVA-105 as a completely saponified product, PVA-205 and PVA-335 as partially saponified products, and MP-203 as a modified polyvinyl alcohol product (which all are trade names and available from Kuraray Co., Ltd.). The coating coverage (per $m^2$ of a support) of polyvinyl alcohol for each of the protective layer is preferably from 0.3 to 4.0 $g/m^2$, and more preferably from 0.3 to 2.0 $g/m^2$.

In the case where the heat-developable photosensitive layer of the invention is used for printing purpose wherein dimensional stability is a particularly significant factor, it is preferable to use a polymer latex in the surface protective layer or a back layer. Descriptions of the polymer latex can be found, e.g., in Taira Okuda and Hiroshi Inagaki ed., *Gousei Jushi Emulsion*, Koubunshi Kankoukai (1978), Takaaki Sugimura, Yasuo Kataoka, Souichi Suzuki and Keishi Kasahara ed., *Gousei Latex no Ouyou*, Koubunshi Kankoukai (1993), and Souichi Muroi, *Gousei Latex no Kagaku*, Koubunshi Kankoukai (1970). Specific examples of the polymer latex include latex of methyl methacrylate (33.5 weight %)/ethyl acrylate (50 weight %)/methacrylic acid (16.5 weight %) copolymer, latex of methyl methacrylate (47.5 weigh %)/butadiene (47.5 weight %)/itaconic acid (5 weight %) copolymer, latex of ethyl acrylate/methacrylic acid copolymer, latex of methyl methacrylate (58.9 weight %)/2-ethylhexyl acrylate (25.4 weight %)/styrene (8.6 weight %)/2-hydroxyethyl methacrylate (5.1 weight %)/acrylic acid (2.0 weight %) copolymer, and latex of methyl methacrylate (64.0 weight %)/styrene (9.0 weight %)/butyl acrylate (20.0 weight %)/2-hydroxyethyl methacrylate (5.0 weight %)/acrylic acid (2.0 weight %) copolymer. Further, the techniques described in JP-A-2000-267226, paragraphs [0021] to [0025], and the techniques described in JP-A-2000-19678, paragraphs [0023] to [0041] may be applied to the binder for surface protective layer. In the surface protective layer, the content of polymer latex is preferably from 10 to 90 weight %, and particularly preferably from 20 to 80 weight %, based on the total binder.

The coating coverage (per $m^2$ of a support) of the total binder (including a water-soluble binder and a latex polymer) for each of the surface protective layer is preferably from 0.3 to 5.0 $g/m^2$, and more preferably from 0.3 to 2.0 $g/m^2$.

The preparation temperature of the coating solution for image-forming layer in the invention is preferably from 30° C. to 65° C., more preferably from 35° C. to 60° C., and still more preferably 35° C. to 55° C. It is also preferred that the temperature of the coating solution for the image-forming layer just after the addition of polymer latex is kept at a temperature of from 30° C. to 65° C.

The image-forming layer of the invention comprises one or more constituent layers provided on a support. When it has one constituent layer, the image-forming layer of the invention contains an organic silver salt, a light-sensitive silver halide, a reducing agent and a binder, and, if desired, additional ingredients including a toning agent, a coating aid and other auxiliary agents. When the image-forming layer has two or more constituent layers, the first image-forming layer (ordinarily the layer adjacent to a support) contains an organic silver salt and a light-sensitive silver halide, and the second image-forming layer or both first and second image-forming layers contain other ingredients. In the case of a multicolor, light-sensitive heat-developable photographic material, the photographic material may have a combination of such two layers for each color or may contain all the ingredients in a single layer as described in U.S. Pat. No. 4,708,928. In the case of a multi-dye, multicolor, light-sensitive, heat-developable photographic material, each adjacent pair of emulsion layers are kept distinctively by providing a functional or non-functional barrier layer between the light-sensitive layers as described in U.S. Pat. No. 4,469,681.

In the light-sensitive layer of the invention, various kinds of dyes and pigments (for example, C.I. Pigment Blue 60, C.I. Pigment Blue 64 or C.I. Pigment Blue 15:6) can be used from the viewpoints of improvement in color tone, prevention of interference pattern formation upon exposure to laser light and prevention of irradiation. Detailed descriptions thereof can be found in WO 98/36322, JP-A-10-268465 and JP-A-11-338098.

In the heat-developable photosensitive material of the invention, an anti-halation layer may be provided on the position far from a light source relative to the light-sensitive layer.

The heat-developable photosensitive material ordinarily has a light-insensitive layer in addition to the light-sensitive layer. According to its position, the light-insensitive layer is classified into tour groups, namely, (1) a protective layer provided on a light-sensitive layer (far from a support), (2) an interlayer provided between adjacent light-sensitive layers or between a light-sensitive layer and a protective layer, (3) an undercoat layer provided between a light-sensitive layer and a support and (4) a back layer provided on the side opposite to a light-sensitive layer. A filter layer is provided in the photosensitive material as the layer classified into group (1) or (2), and an anti-halation layer is provided in the photosensitive material as the layer classified into group (3) or (4).

Descriptions of the anti-halation layer can be found in JP-A-11-65021, paragraphs [0123] and [0124], JP-A-11-223898, JP-A-9-230531, JP-A-10-36695, JP-A-10-104779, JP-A-11-231457, JP-A-11-352625 and JP-A-11-352626.

The anti-halation layer contains an anti-halation dye having absorption in a wavelength of light for exposure. When the exposure wavelength is present an infrared region, an infrared absorbing dye is used as the anti-halation dye. In such a case, it is preferable that the dye used has no absorption within the visible region.

When the prevention of halation is performed with a dye having absorption in the visible region, it is preferred that color of the dye used is substantially not present after the image formation. Therefore, appropriate means for decoloring the dye by the heat of heat development is preferably adopted. In particular, it is preferred to add a thermally decoloring dye and a base precursor to a light-insensitive layer so that the light-insensitive layer functions as an anti-halation layer. These techniques are described in JP-A-11-231457.

The amount of decoloring dye added is determined depending the intended purpose of the dye. Ordinarily, the dye is used in an amount for providing an optical density (absorbance) higher than 0.1 measured at the intended wavelength. The optical density is preferably from 0.15 to 2, and more preferably from 0.2 to 1. In order to obtain such an optical density, the amount of dye used is ordinarily approximately from 0.001 to 1 $g/m^2$.

By decoloring the dye appropriately, the optical density after the heat development can be lowered to 0.1 or below. Two or more decoloring dyes may be used together in a thermal decoloration type recording material or a heat-developable photosensitive material. Also, two or more base precursors may be used together.

In the thermal decoloration system using such a decoloring dye and a base precursor, it is preferred to use a substance capable of lowering a melting point by 3° C. (deg) or more when mixed with the base precursor as described in JP-A-11-352626 (for example, diphenylsulfone or 4-chlorophenyl(phenyl)sulfone), or 2-naphthylbenzoate from the viewpoint of thermal decoloration capability.

For the purpose of improving color tone of silver and preventing change of the image with the lapse of time, a coloring agent having its absorption maximum in the wavelength region of from 300 to 450 nm can be added in the invention. Such coloring agents are described, for example, in JP-A-62-210458, JP-A-63-104046, JP-A-63-103235, JP-A-63-208846, JP-A-63-306436, JP-A-63-314535, JP-A-01-61745 and JP-A-2001-100363.

The coloring agent is ordinarily added in an amount of from 0.1 mg/m$^2$ to 1 g/m$^2$. A layer to which the coloring agent is added is preferably a back layer provided on the side opposite to the light-sensitive layer.

The heat-developable photosensitive material of the invention is preferably a so-called single-sided photosensitive material, namely, a photosensitive material having at least one light-sensitive layer containing a silver halide emulsion on one side of a support and on the other side of the support a back layer.

(Description of Matting Agent)

In the invention, addition of a matting agent is preferable for the purpose of improving suitability for conveyance. Descriptions of the matting agent can be found in JP-A-11-65021, paragraphs [0126] and [0127]. The amount of matting agent added is preferably from 1 to 400 mg, and more preferably from 5 to 300 mg, per m$^2$ of the photosensitive material in terms of coating coverage.

The shape of matting agent used in the invention may be a regular or irregular shape, but preferably a regular shape, especially a spherical shape. The average particle diameter is preferably from 0.5 to 10 $\mu$m, more preferably from 1.0 to 8.0 $\mu$m, and still more preferably from 2.0 to 6.0 $\mu$m. The variation coefficient of particle size distribution is preferably 50% or below, more preferably 40% or below, and still more preferably 30% or below. The term "variation coefficient" as used herein means a value represented by (standard deviation of particle diameter)/(average value of particle diameter)×100. Further, it is preferred to use two matting agents each having a small variation coefficient and having a ratio of respective average diameters of 3 or more.

The emulsion layer surface may have any matting degree so far as it causes no stardust defect, and it has preferably Bekk smoothness of from 30 to 2,000 seconds, particularly from 40 to 1,500 seconds. The Bekk smoothness can be easily determined in accordance with Japanese Industrial Standards (JIS) P8119, entitled "Paper and Paper Board Smoothness Testing Method by Bekk Smoothness Tester", and TAPPI Standard Method T479.

The matting degree of the back layer surface in the invention is preferably from 10 to 1,200 seconds, more preferably from 20 to 800 seconds, and still more preferably from 40 to 500 seconds, in terms of Bekk smoothness.

In the invention, it is preferred that the matting agent is contained in the outermost surface layer, a layer functioning as the outermost surface layer or a layer near the outer surface. It is also preferred to add the matting agent to a layer functioning as the so-called protective layer.

The back layer applicable to the invention is described in JP-A-11-65021, paragraphs [0128] to [0130].

In the heat-developable photosensitive material of the invention, a pH of the surface before heat-development processing is preferably 7.0 or below, and more preferably 6.6 or below. The lower limit of surface pH is not particularly limited, but it is of the order of 3. The most preferable range of surface pH is from 4 to 6.2. For adjustment of the surface pH, an organic acid such as a phthalic acid derivative, a nonvolatile inorganic acid such as sulfuric acid, or a volatile base such as ammonia is preferably used from the viewpoint of decreasing the pH of the surface. In particular, ammonia is preferable for attaining a low pH value of the surface because it is easy to volatilize and to remove at the coating step or before heat development.

In addition, it is also preferred to use ammonia together with a nonvolatile base, for example, sodium hydroxide, potassium hydroxide or lithium hydroxide. A method of measuring the surface pH is described in JP-A-2000-284399, paragraph [0123].

A hardener may be used in each of the constituent layers of the invention, for example, the light-sensitive layer, the protective layer and the back layer. Various hardening methods and hardeners are described in T. H. James, *THE THEORY OF THE PHOTOGRAPHIC PROCESS FOURTH EDITION*, pages 77 to 87, Macmillan Publishing Co., Inc. (1977). Preferred examples of the hardener include chrome alum, sodium salt of 2,4-dichloro-6-hydroxy-s-triazine, N,N-ethylenebis(vinylsulfonacetamide), N,N-propylenebis (vinylsulfonacetamide), the polyvalent metal ions described on page 78 of the book described above, the polyisocyanates described, e.g., in U.S. Pat. No. 4,281,060 and JP-A-6-208193, the epoxy compounds described, e.g., in U.S. Pat. No. 4,791,042, and the vinylsulfone compounds described, e.g., in JP-A-62-89048.

The hardener is added as a solution, and the suitable timing at which the solution is added to a coating solution for protective layer is from 180 minutes before to just before the start of coating, preferably from 60 minutes to 10 seconds before the start of coating. There are no particular restrictions on the method and the condition for mixing the hardener with the coating solution so far as the effects of the invention can be sufficiently achieved. Specific examples of the mixing method include a mixing method using a tank controlled so that the average stay time calculated from the rate of liquid flow added to the tank and the volume of the liquid sent into a coater becomes the desired value, and a method of using a static mixer as described in N. Harnby, M. F. Edwards and A. W. Nienow, *Ekitai Kongou Gijutsu*, (translated by Koji Takahashi), Chapter 8, The Nikkan Kogyo Shimbun, Ltd. (1989).

Surfactants for use in the invention include those described in JP-A-11-65021, paragraph [0132], solvents for use in the invention include those described in JP-A-11-65021, paragraph [0133], supports for use in the invention include those described in JP-A-11-65021, paragraph [0134], anti-static or conductive layers for use in the invention include those described in JP-A-11-65021, paragraph [0135], color image formation methods for use in the invention include those described in JP-A-11-65021, paragraph [0136], and lubricants for use in the invention include those described in JP-A-11-84573, paragraphs [0061] to [0064], and JP-A-2001-83679, paragraphs [0049] to [0062].

It is preferred for the photosensitive material of the invention to have a conductive layer containing a metal oxide. As a conductive material contained in the conductive layer, metal oxides in which oxygen defects or foreign metal atoms are introduced and thereby increasing conductivity are preferably used. Preferable metal oxides include ZnO, $TiO_2$ and $SnO_2$. The addition of Al and In to ZnO, that of Sb, Nb, P and halogen element to $SnO_2$, and that of Nb and Ta to $TiO_2$ are preferred. In particular, $SnO_2$ to which Sb is added is preferably used. The amount of foreign atom added is preferably from 0.01 to 30 mole %, and more preferably from 0.1 to 10 mole %. The metal oxide used may have any of spherical, acicular and tabular shapes. From the viewpoint of effectiveness of imparting conductivity, however, acicular grains having the major axis/minor axis ratio of at least 2.0, preferably from 3.0 to 50, are advantageously used. The mount of metal oxide used is preferably from 1 to 1,000 $mg/m^2$, more preferably from 10 to 500 $mg/m^2$, and still more preferably from 20 to 200 $mg/m^2$. The conductive layer may be arranged on the emulsion layer side or the back layer side, but preferably it is disposed between the support and the back layer. Specific examples of the conductive layer for use in the invention are described in JP-A-7-295146 and JP-A-11-223901. It is preferred that the heat-developable photosensitive material of the invention has a sufficiently low cross section resistance by means of the presence of the conductive layer. The cross section resistance is preferably not more than $1\times10^{11}$ Ω/□, more preferably not more than $5\times10^{10}$ Ω/□, and still more preferably not more than $1\times10^{10}$ Ω/□.

As a transparent support, a polyester film, particularly a polyethylene terephthalate film, which has been subjected to heat treatment at a temperature ranging from 130 to 185° C. for the purposes of relaxing internal strains remaining in the film through biaxial stretch and eliminating the distortion caused by thermal shrinkage during the heat development, is preferably used. In the case of a heat-developable photosensitive material for medical use, the transparent support may be colored with a blue dye (e.g., Dye-1 used in Example of JP-A-8-240877), or it may be colorless. To the support are preferably applied undercoat technologies using the water-soluble polyester described in JP-A-11-84574, the styrene-butadiene copolymer described in JP-A-10-186565 and the vinylidene chloride copolymer described in JP-A-2000-39684 and JP-A-2001-83679, paragraphs [0063] to [0080], respectively. To the anti-static layer and the undercoat layer can be applied the technologies described in JP-A-56-143430, JP-A-56-143431, JP-A-58-62646, JP-A-56-120519, JP-A-11-84573, paragraphs [0040] to [0051], U.S. Pat. No. 5,575,957 and JP-A-11-223898, paragraphs [0078] to [0084].

The heat-developable photosensitive material is preferably a mono-sheet type (a type which forms images in the heat-developable photosensitive material without using another sheet such as an image-receiving material).

To the heat-developable photosensitive material may further be added an antioxidant, a stabilizer, a plasticizer, an ultraviolet absorbent and a coating aid. Such additives are added to the light-sensitive layer or the light-insensitive layer. For details of the additives, WO 98/36322, EP-A-803764, JP-A-10-186567 and JP-A-10-186568 can be referred to.

In preparing the heat-developable photosensitive material, any coating method may be employed. More specifically, a wide variety of coating operations including extrusion coating, slide coating, curtain coating, dip coating, knife coating, flow coating and extrusion coating using a hopper as described in U.S. Pat. No. 2,681,294 can be applied. Moreover, the extrusion coating and the slide coating techniques described in Stephen F. Kistler and Petert M. Schweizer, *LIQUID FILM COATING*, pages 399–536, CHAPMAN and HALL CO. (1997) are preferably applied. In particular, the slide coating techniques are preferably used. Examples of the shape of a slide coater for use in the slide coating operation are illustrated in FIG. 11*b*.1 on page 427 of the above-described book. Further, if desired, simultaneous coating of two or more layers may be performed in accordance with the methods as described in pages 399 to 536 of the above-described book, U.S. Pat. No. 2,761,791 and British Patent 837,095.

The coating solution for organic silver salt-containing layer used in the invention is preferably a so-called thixotropic fluid. For the techniques on the thixotropic fluid, JP-A-11-52509 can be referred to. The coating solution for organic silver salt-containing layer has preferably a viscosity of from 400 to 100,000 mPa·s, and more preferably from 500 to 20,000 mPa·s, at a shear rate of 0.1 $s^{-1}$. The viscosity of the coating solution at a shear rate of 1,000 $S^{-1}$ is preferably from 1 to 200 mPa·s, and more preferably from 5 to 80 mPa·s.

The techniques described in EP-A-803764, EP-A-883022, WO 98/36322, JP-A-56-62648, JP-A-58-62644, JP-A-9-43766, JP-A-9-281637, JP-A-9-297367, JP-A-9-304869, JP-A-9-311405, JP-A-9-329865, JP-A-10-10669, JP-A-10-62899, JP-A-10-69023, JP-A-10-186568, JP-A-10-90823, JP-A-10-171063, JP-A-10-186565, JP-A-10-186567, JP-A-10-186569 to JP-A-10-186572, JP-A-10-197974, JP-A-10-197982, JP-A-10-197983, JP-A-10-197985 to JP-A-10-197987, JP-A-10-207001, JP-A-10-207004, JP-A-10-221807, JP-A-10-282601, JP-A-10-288823, JP-A-10-288824, JP-A-10-307365, JP-A-10-312038, JP-A-10-339934, JP-A-11-7100, JP-A-11-15105, JP-A-11-24200, JP-A-11-24201, JP-A-11-30832, JP-A-11-84574, JP-A-11-65021, JP-A-11-109547, JP-A-11-125880, JP-A-11-129629, JP-A-11-133536 to JP-A-11-133539, JP-A-11-133542, JP-A-11-133543, JP-A-11-223898, JP-A-11-352627, JP-A-11-305377, JP-A-11-305378, JP-A-11-305384, JP-A-11-305380, JP-A-11-316435, JP-A-11-327076, JP-A-11-338096, JP-A-11-338098, JP-A-11-338099, JP-A-11-343420, JP-A-2000-187298, JP-A-2000-10229, JP-A-2000-47345, JP-A-2000-206642, JP-A-2000-98530, JP-A-2000-98531, JP-A-2000-112059, JP-A-2000-112060, JP-A-2000-112104, JP-A-2000-112064 and JP-A-2000-171936 can also be applied to the heat-developable photosensitive material of the invention.

(Description of Packaging Material)

For the purpose of controlling changes caused in photographic properties when the photosensitive material of the invention is stored before the imagewise exposure, or improving the resistance of the photosensitive material of the invention to curl and core set, it is preferred to package the photosensitive material in a packaging material having a low oxygen permeability and/or a low moisture permeability. The oxygen permeability of the packaging material is preferably not more than $57\times10^{-6}$ $ml/Pa\cdot m^2\cdot s$ (50 $ml/atm\cdot m^2\cdot day$), more preferably not more than $11.4\times10^{-6}$ $ml/Pa\cdot m^2\cdot s$ (10 $ml/atm\cdot m^2\cdot day$), and still more preferably not more than $1.14\times10^{-6}$ $ml/Pa\cdot m^2\cdot s$ (1.0 $ml/atm\cdot m^2\cdot day$), measured at 25° C. The moisture permeability is preferably not more than $11.4\times10^{-6}$ $g/Pa\cdot m^2\cdot s$ (10 g/atm·m 2·day), more preferably not more than $5.7\times10^{-6}$ $g/Pa\cdot m^2\cdot s$ (5 $g/atm\cdot m^2\cdot day$, and still more preferably not more than $1.14\times10^{-6}$ $g/Pa\cdot m^2\cdot s$ (1.0 $g/atm\cdot m^2\cdot day$).

Specific examples of the packaging material having such low oxygen permeability and/or moisture permeability include the packaging materials described in JP-A-8-254793 and JP-A-2000-206653.

(Description of Heat Development)

The heat-developable photosensitive material of the invention may be developed by any method, but it is ordinarily developed by temperature rise after the imagewise exposure. The temperature for development is preferably from 80° C. to 250° C., more preferably from 100° C. to 140° C., and still more preferably from 110° C. to 130° C. The development time is preferably from 1 to 60 seconds, more preferably from 3 to 30 seconds, still more preferably from 5 to 25 seconds, and particularly preferably from 7 to 15 seconds.

The heat development may be performed using any of a drum heater and a plate heater, but the use of a plate heater is more preferred in the invention. To the heat development using a plate heater, it is preferable to apply the method described in JP-A-11-133572. More specifically, the method uses a heat-development apparatus that enables conversion of latent images formed in the heat-developable photosensitive material into visible images by bringing the photosensitive material into contact with a heating means installed in the heat-development section. The apparatus is characterized in that the heating means installed therein is a plate heater, a plurality of pressing rollers are arranged along one surface of the plate heater and the heat-developable photosensitive material is passed between the plate heater and the pressing rollers, thereby effecting the heat development. It is preferable that the plate heater is divided into from two to six segments and the temperature of the head segment is reduced by the order of 1 to 10° C. For instance, four plate heaters capable of independently controlling their temperatures are used and they are adjusted at temperatures of 112° C., 119° C., 121° C. and 120° C., respectively. Such a method is described in JP-A-54-30032, and can discharge the moisture and the organic solvent contained in the heat-developable photosensitive material outside the system and also restrain the change in the shape of support caused by an abrupt heating of the heat-developable photosensitive material.

The heat-developable photosensitive material of the invention may be exposed in accordance with any method. As an exposure light source, however, laser light is preferred. Preferred examples of the laser light applied to the invention include gas laser (e.g., $Ar^+$, He—Ne), YAG laser, dye laser and semiconductor laser. Also, combination of semiconductor laser and a second harmonic generating device can also be used. A gas laser or semiconductor laser emitting red to infrared light is preferred.

As a medical laser imager provided with an exposure section and a heat development section, Fuji Medical Dry Laser Imager FM-DP L can be used. The Fuji Medical Dry Laser Imager FM-DP L is described in *Fuji Medical Review,* No. 8, pages 39 to 55. The techniques described therein are surely applied to a laser imager used for the heat-developable photosensitive material of the invention. Further, the heat-developable photosensitive material of the invention can also be utilized as a heat-developable photosensitive material for the laser imager in "AD Network" which Fuji Medical System offers as a network system compliant with the DICOM standard.

The heat-developable photosensitive material of the invention forms black-and-white images based on silver images, and preferably used as a heat-developable photosensitive material for medical diagnosis, a heat-developable photosensitive material for industrial photography, a heat-developable photosensitive material for graphic art and a heat-developable photosensitive material for COM purpose. Particularly, the heat-developable photosensitive material of the invention is preferably used by cutting it into a sheet form. It is preferably used for a heat-developing machine having a tray for stocking a stack of sheet-formed heat-developable photosensitive materials.

The invention will be described in more detail with reference to the following examples, but the invention should not be construed as being limited thereto.

Example 1

(Production of Polyethylene Terephthalate (PET) Support)

PET having intrinsic viscosity (IV) of 0.66 (measured in a 6:4 (weight ratio) mixture of phenol and tetrachloroethane at 25° C.) was produced using terephthalic acid and ethylene glycol in a conventional manner. The PET obtained was pelletized and dried at 130° C. for 4 hours. Then, it was molten at 300° C., extruded from a T die and quenched, thereby preparing a unstretched film having a thickness so as to provide a thickness of 175 μm through the subsequent thermal setting, The film was stretched to 3.3 times its original length by means of rollers with different peripheral speeds, and then stretched on a tenter to 4.5 times its original width. The temperatures during these stretching operations were 110° C. and 130° C., respectively. Thereafter, the film was thermally set at 240° C. for 20 seconds and further, under the same temperature, subjected to 4% relaxation in a lateral direction. The part corresponding to the tenter's chuck was slit off, and the both sides underwent knurl processing. The film was wound under a tension of 4 kg/cm$^2$ to form a roll of 175 μm-thick film.

(Surface Corona Treatment)

By means of a solid-state corona treater, Model 6 KVA produced by Pillar Technologies, both surfaces of the support was treated at a rate of 20 m/min at room temperature. From the readout values of current and voltage under the operation, it was found that the support was treated at 0.375 kV·A·min/m$^2$. The treatment frequency and the gap clearance between the electrode and the dielectric roll under the operation were 9.6 kHz and 1.6 mm, respectively.

(Production of Support with Undercoat Layer)

<Preparation of Coating Composition for Undercoat Layer>

Formulation (1) (for undercoat layer on light-sensitive layer side):

| | |
|---|---|
| Pesresin A-520 produced by Takamatsu Oil & Fat Co., Ltd. (30 wt % solution) | 59 g |
| Polyethylene glycol monononylphenyl ether (average number of ethylene oxide units = 8.5, 10 wt % solution) | 5.4 g |
| MP-1000 produced by Soken Chemical and Engineering Co., Ltd. (fine particles of polymer, average particle size: 0.4 μm) | 0.91 g |
| Distilled water | 935 ml |

Formulation (2) (for first layer on back side):

| | |
|---|---|
| Styrene-butadiene copolymer latex (solid content = 40 wt %, styrene/ butadiene = 68/32 by weight) | 158 g |
| Sodium salt of 2,4-dichloro-6-hydroxy-s-triazine (8 wt % aqueous solution) | 20 g |
| Sodium laurylbenzenesulfonate (1 wt % aqueous solution | 10 ml |
| Distilled water | 854 ml |

Formulation (3) (for second layer on back side):

| | |
|---|---|
| $SnO_2SbO$ (9/1 by weight, average particle size: 0.038 μm, 17 wt % dispersion) | 84 g |
| Gelatin (10 wt % aqueous solution) | 89.2 g |
| Metalose TC-5 produced by Shin-Etsu Chemical Co., Ltd. (2 wt % aqueous solution) | 8.6 g |
| MP-1000 produced by Soken Chemical and Engineering Co., Ltd. | 0.01 g |
| Sodium dodecylbenzenesulfonate (1 wt % aqueous solution) | 10 ml |
| NaOH (1 wt % aqueous solution) | 6 ml |
| Proxel produced by Imperial Chemical Industries PLC | 1 ml |
| Distilled water | 805 ml |

The biaxially stretched 175 μm-thick polyethylene terephthalate support subjected to the corona discharge processing described above was coated on one side (light-sensitive layer side) with the undercoat layer composition of formulation (1) at a wet coverage of 6.6 ml/m$^2$ (per side) by means of a wire bar, and dried at 180° C. for 5 minutes. Subsequently, the support was coated on the other side (back side) with the undercoat layer composition of formulation (2) at a wet coverage of 5.7 ml/m$^2$ by means of a wire bar, and dried at 180° C. for 5 minutes, and further thereon with the undercoat layer composition of formulation (3) at a wet coverage of 7.7 ml/m$^2$ by means of a wire bar, and dried at 180° C. for 6 minutes, whereby the support provided with the undercoat layers was produced. Cross section resistance of the support measured under conditions of 25° C. and 25% RH was $3\times10^{11}$ Ω/□.

(Preparation of Coating Composition for Back Side)

<Preparation of Solid Fine Particle Dispersion (a) of Base Precursor>

Distilled water was admixed with 1.5 kg of Base Precursor Compound 1, 225 g of a surfactant (Demol N, trade name, produced by Kao Corp.), 937.5 g of diphenylsulfone and 15 g of butyl p-hydroxybenzoate (Mekkins, trade name, produced by Ueno Pharmaceutical Co., Ltd.) to make the total amount of the resulting mixture 5.0 kg. The mixture was subjected to beads dispersion by means of a horizontal sand mill (UVM-2 produced by AIMEX Co., Ltd.). More specifically, the mixture was fed into the sand mill UVM-2 packed with zirconia beads having an average diameter of 0.5 mm by means of a diaphragm pump, and underwent a dispersing operation under an inner pressure of not less than 50 hPa until the desired average particle size was attained.

While making spectral absorption measurements during the dispersing operation, the operation was continued until the dispersion prepared came to have an absorbance ratio of at least 2.2 between the spectral absorption at 450 n=and that at 650 nm (D450/D650). The thus obtained dispersion was diluted with distilled water so as to have the base precursor concentration of 20 weight %, and filtrated for removal of dusts (by means of a polypropylene filter having an average pore size of 3 μm), and then put to practical use.

<Preparation of Solid Fine Particle Dispersion of Dye>

To 6.0 kg of Cyanine Dye Compound 1, 3.0 kg of sodium p-dodecylbenzenesulfonate, 0.6 kg of a surfactant (Demol SNE produced by Kao Corp.) and an antifoaming agent (Surfynol 104E, trade name, produced by Nissin Chemical Industry Co., Ltd.) were mixed with distilled water to make the total amount of the resulting mixture 60 kg. The mixture was subjected to dispersion by means of a horizontal sand mill (UVM-2 produced by AIMEX Co., Ltd.). More specifically, the mixture was fed into the sand mill UVM-2 with zirconia beads having an average diameter of 0.5 mm.

While making spectral absorption measurements during the dispersing operation, the operation was continued until the dispersion prepared came to have an absorbance ratio of at least 5.0 between the spectral absorption at 650 nm and that at 750 nm (D650/D750). The thus obtained dispersion was diluted with distilled water so as to have the cyanine dye concentration of 6 weight %, and filtrated for removal of dusts (by means of a filter having an average pore size of 1 μm), and then put to practical use.

(Preparation of Coating Composition for Anti-Halation Layer)

A coating composition for anti-halation layer was prepared by mixing 30 g of gelatin, 24.5 g of polyacrylamide, 2.2 g of an aqueous sodium hydroxide solution having a concentration of 1 mole/liter, 2.4 g of monodisperse fine particles of polymethyl methacrylate (average particle size: 8 μm, standard deviation of particle size: 0.4), 0.08 g of benzisothiazolinone, 35.9 g of Solid Fine Particle Dispersion of Dye described above, 74.2 g of Solid Fine Particle Dispersion (a) of Base Precursor described above, 0.6 g of sodium polystyrenesulfonate, 0.21 g of Blue Dye Compound 1, 0.15 g of Yellow Dye Compound 1 and 8.3 g of acrylic acid/ethyl acrylate copolymer (copolymerization ratio: 5/95 by weight) latex, and adding water to make the total volume 818 ml.

(Preparation of Coating Composition for Protective Layer on Back Side)

A coating composition for protective layer on the back side was prepared in a vessel kept at 40° C. by mixing 40 g of gelatin, a liquid paraffin emulsion containing 1.5 g of liquid paraffin, 6.8 g of an aqueous sodium hydroxide solution having a concentration of 1 mole/liter, 0.5 g of sodium tert-octylphenoxyethoxyethanesulfonate, 0.27 g of sodium polystyrenesulfonate, a fluorine-containing surfactant as shown in Table 1 below, 6.0 g of acrylic acid/ethyl acrylate copolymer (copolymerization ratio: 5/95 by weight) and 2.0 g of N,N-ethylenebis(vinylsulfonacetamide), and adding water to make the total volume 1,000 ml.

(Preparation of Silver Halide Emulsion)

<Preparation of Silver Halide Emulsion 1>

A solution prepared by adding 3.1 ml of a 1 wt % potassium bromide solution to 1,421 ml of distilled water and then adding thereto 3.5 ml of diluted sulfuric acid having a concentration of 0.5 mole/liter and 31.7 g of phthalated gelatin was placed in a reaction pot made of stainless steel and kept at 30° C. with stirring. Thereto, Solution A prepared by diluting 22.22 g of silver nitrate to 95.4 ml with distilled water and Solution B prepared by diluting 15.3 g of potassium bromide and 0.8 g of potassium iodide to 97.4 ml with distilled water were added at constant flow rates in their entirety over a 45-second period. Thereafter, 10 ml of a 3.5 wt % aqueous solution of hydrogen peroxide was added, followed by addition of 10.8 ml of a 10 wt % aqueous solution of benzimidazole. Furthermore, Solution C prepared by diluting 51.86 g of silver nitrate to 317.5 ml with distilled water and Solution D prepared by diluting 44.2 g of potassium bromide and 2.2 g of potassium iodide to 400 ml with distilled water were added in a manner that Solution C was added at a constant flow rate in its entirety over a 20-minute period and Solution D was added in its entirety in accordance with a controlled double jet method while keeping the pAg of the mixture at 8.1. After a 10-minute lapse from the start of the addition of Solutions C and D, potassium hexachloroiridate(III) in an amount of $1\times10^{-4}$ mole per mole of silver was further added at once. In addition, after a 5-second lapse from the completion of the addition of Solution C, an aqueous solution of potassium iron(II) hexacyanide in an amount of $3\times10^{-4}$ mole per mole of silver was added at once. The pH of the resulting mixture was adjusted to 3.8 by the use of diluted sulfuric acid having a concentration of 0.5 mole/liter. The reaction mixture ceased to be stirred and was subjected successively to precipitation, desalting and washing operations. The pH was adjusted to 5.9 with an aqueous solution of sodium hydroxide having a concentration of 1 mole/liter. Thus, a silver halide dispersion having a pAg of 8.0 was prepared.

The silver halide dispersion was kept at 38° C. with stirring and mixed with 5 ml of a 0.34 wt % methanol solution of 1,2-benzisothiazolin-3-one. After a lapse of 40 minutes, the temperature of the dispersion was raised to 47° C. After a 20-minute lapse from the temperature raise, sodium benzenethiosulfonate in an amount of $7.6\times10^{-5}$ mole/mole silver was added as a methanol solution. After a lapse of 5 minutes, Tellurium Sensitizer C in an amount of $2.9\times10^{-4}$ mole per mole of silver was added as a methanol solution, followed by ripening for 91 minutes. Then, a methanol solution containing a 3:1 by mole mixture of Spectral Sensitizing Dyes A and B was added in the total amount of the sensitizing dyes of $1.2\times10^{-3}$ mole per mole of silver. After a 1-miture lapse, 1.3 ml of a 0.8 wt % methanol solution of N,N'-dihydroxy-N"-diethylmelamine was added thereto. After a 4-minute lapse, thereto were further added $4.8\times10^{-3}$ mole/mole silver of 5-methyl-2-mercaptobenzimidazole as a methanol solution, $5.4\times10^{-3}$ mole/mole silver of 1-phenyl-2-heptyl-5-mercapto-1,3,4-triazole as a methanol solution and $8.5\times10^{-3}$ mole/mole silver of 1-(3-methylureidophenyl)-5-mercaptotetrazole sodium salt as an aqueous solution. Thus, Silver Halide Emulsion 1 was prepared.

The grains in the thus prepared silver halide emulsion were silver iodobromide grains containing 3.5 mole of iodide homogeneously and having an average sphere equivalent diameter of 0.042 $\mu$m and a variation coefficient of 20% with respect to sphere equivalent diameter. For determination of such values concerning grain size, 1,000 grains were examined with an electron microscope, and the average thereof was calculated. By using the Kubelka-Munk method, it was determined that these grains had {100} planes in a proportion of 80 %.

<Preparation of Silver Halide Emulsion 2>

Silver Halide Emulsion 2 was prepared in the same manner as in Silver Halide Emulsion 1, except that the solution temperature at the time of grain formation was changed from 30° C. to 47° C., that the preparation of Solution B was changed to dilution of 15.9 g of potassium bromide to a volume of 97.4 ml with distilled water, that the preparation of Solution D was changed to dilution of 45.8 g of potassium bromide to a volume of 400 ml with distilled water, and that the addition of potassium iron (II) hexcyanide was omitted. Similarly to the preparation of Silver Halide Emulsion 1, the precipitation, desalting, washing and dispersing operations were carried out successively. Then, the spectral sensitization and chemical sensitization were performed in the same manner as in Emulsion 1, except that the addition amount of Tellurium Sensitizer C was changed to $1.1\times10^{-4}$ mole per mole silver, that the addition amount of the methanol solution containing a 3:1 by mole mixture of Spectral Sensitizing Dyes A and B was changed to $7.0\times10^{-4}$ mole per mole silver in the total amount of Spectral Sensitizing Dyes A and B, that the addition amount of 1-phenyl-2-heptyl-5-mercapto-1,3,4-triazole was changed to $3.3\times10^{-3}$ mole per mole silver, and that the addition amount of 1-(3-methylureidophenyl)-5-mercaptotetrazole sodium salt was changed to $4.7\times10^{-3}$ mole per mole silver, thereby preparing silver halide Emulsion 2. The emulsion grains of silver halide Emulsion 2 were cubic grains of pure silver bromide having an average sphere equivalent diameter of 0.080 $\mu$m and a variation coefficient of 20% with respect to the sphere equivalent diameter.

<Preparation of Silver Halide Emulsion 3>

Silver Halide Emulsion 3 was prepared in the same manner as in Silver Halide Emulsion 1, except that the solution temperature at the time of grain formation was changed from 30° C. to 27° C. Similarly to the preparation of Silver Halide Emulsion 1, the precipitation, desalting, washing and dispersing operations were carried out. Then, the procedures were performed in the same manner as in Emulsion 1, except that a solid dispersion containing Spectral Sensitizing Dyes A and B in a ratio of 1:1 by mole was added as an aqueous gelatin solution in an amount of $6\times10^{-3}$ mole per mole silver in terms of the total amount of the Sensitizing Dyes A and B, that the amount of Tellurium Sensitizer C was changed to $5.2\times10^{-4}$ mole per mole silver, and that after a lapse of 3 minutes from the addition of Tellurium Sensitizer C, bromauric acid in an amount of $5\times10^{-4}$ mole per mole of silver and potassium thiocyanate in an amount of $2\times10^{-3}$ mole per mole of silver were added. The thus obtained emulsion grains of silver halide Emulsion 3 were silver iodobromide grains containing 3.5 mole % iodide homogeneously and having an average sphere equivalent diameter of 0.034 $\mu$m and a variation coefficient of 20% with respect to sphere equivalent diameter.

<Preparation of Mixed Emulsion A for Coating Composition>

Silver Halide Emulsions 1, 2 and 3 were dissolved in a ratio of 70:15:15 by weight, and thereto was added a 1 wt % aqueous solution of benzothiazolium iodide in an amount of $7\times10^{-3}$ mole per mole silver. Further, water was added thereto in an amount that the silver halide content became 38.2 g per kg of a mixed emulsion for coating composition, and 1-(3-methylureidophenyl)-5-mercaptotetrazole sodium salt was added thereto in an amount of 0.34 g per kg of a mixed emulsion for a coating composition.

(Preparation of Fatty Acid Silver Salt Dispersion)

<Preparation of Dispersion A of Fatty Acid Silver Salt>

Behenic acid (Edenor C22-85R, trade name, produced by Henkel Co.) in an amount of 87.6 kg was mixed with 423 liters of distilled water, 49.2 liters of an aqueous solution containing NAOH in a concentration of 5 mole/liter and 120 liters of tert-butanol, and stirred for one hour at 75° C. to prepare a sodium behenate solution A. Separately, 206.2 liters of an aqueous solution (pH 4.0) containing 40.4 kg of silver nitrate was prepared and kept at 10° C. A reaction vessel in which 635 liters of distilled water and 30 liters of tert-butanol were placed was kept at 30° C. with vigorous stirring, and thereto the total amount of the foregoing sodium behenate solution A and the total amount of the foregoing silver nitrate solution were added at their individual constant flow rates over a period of 93 minutes and 15 seconds and a period of 90 minutes, respectively. More specifically, these two solutions were added in the following manner. The aqueous solution of silver nitrate alone was added for a period from the beginning of addition to a lapse of 11 minutes, then the sodium behenate solution A began to be added, and further the addition of the sodium behenate solution A alone was continued for a period of 14 minutes and 15 seconds after finishing the addition of aqueous silver nitrate solution. During the addition, the temperature inside the reaction vessel was maintained at 30° C. by controlling externally so that the solution temperature was kept constant. A double pipe laid for feeding the sodium behenate solution A was kept warm by circulating hot water through the outer part thereof, and the solution temperature at the exit of the addition nozzle tip was regulated at 75° C. As to a jacketed pipe laid for feeding the aqueous silver nitrate solution, the solution temperature was kept constant by circulating cold water through the outer part of the pipe. The nozzle tip from which the sodium behenate solution A was fed and that from which the aqueous silver nitrate solution was fed were arranged symmetrically about the stirring axis, and placed above the reaction solution so as to avoid the contact of those solutions with the reaction solution.

After the addition of the sodium behenate solution A was completed, the reaction solution was stirred for 20 minutes as the temperature thereof was kept unchanged, and then the solution temperature was raised to 35° C. over a period of 30 minutes, followed by conducting ripening for 210 minutes. Immediately after the completion of the ripening, the solid matter was separated by centrifugal filtration and washed with water till the filtrated water became to have a conductivity of 30 μS/cm. Thus, the silver salt of fatty acid was obtained. The solid matter obtained was stored as wet cake without undergoing any drying treatment.

The shape of the thus produced silver behenate grain was evaluated by electron microphotography. As a result, the grains were found to have crystals of scaly shape, specifically with, on average, a=0.14 μm, b=0.4 μm and c=0.6 μm, an average aspect ratio of 5.2, an average sphere equivalent diameter of 0.52 μm and a variation coefficient of 15% with respect to the sphere equivalent diameter (wherein a, b and c have the same meaning as defined hereinbefore, respectively).

To the wet cake in an amount corresponding to 260 kg on a dry solid basis, 19.3 kg of polyvinyl alcohol (PVA-217, trade name, produced by Kuraray Co. Ltd.) was added. Further, water was added thereto in an amount for adjusting the total weight of the mixture to 1,000 kg, and the mixture was made into slurry with a dissolver blade and preliminary dispersed with a pipeline mixer (Model PM-10, produced by Mizuho Industrial Co., Ltd.).

The preliminarily dispersed solution was processed three times using a dispersing machine, Microfluidizer M-610 (trade name, produced by Microfluidex International Corporation, wherein Z-type interaction chamber was used) under the pressure adjusted to 1,260 kg/cm$^2$, thereby preparing a dispersion of silver behenate. The dispersion temperature was set at 18° C. by providing with spiral heat exchangers on the front and the rear of interaction chamber respectively and controlling the temperature of the coolant used therein.

<Preparation of Dispersion B of Fatty Acid Silver Salt>

<<Preparation of Recrystallized Behenic Acid>>

100 kg of behenic acid (Edenor C22-85R, trade name, produced by Henkel Co.) was mixed with 1,200 kg of isopropyl alcohol and dissolved at 50° C. The solution was filtered through a filter having a pore diameter of 10 μm and then cooled to 30° C. to recrystallize. During the recrystallization procedure, the cooling rate was controlled to 3° C./hr. The resulting crystal was subjected to centrifugal filtration, washed by pouring 100 kg of isopropyl alcohol and dried. The crystal thus obtained was esterified and subjected to GC-FID measurement. As a result, the crystal was found to have a behenic acid content of 96%, a lignoceric acid content of 2%, an arachidic acid content of 2% and an erucic acid content of 0.001%.

<<Preparation of Dispersion B of Fatty Acid Silver Salt>>

The recrystallized behenic acid in an amount of 88 kg was mixed with 422 liters of distilled water, 49.2 liters of an aqueous solution containing NaOH in a concentration of 5 mole/liter and 120 liters of tert-butyl alcohol, and stirred at 75° C. for one hour to prepare a sodium behenate solution B. Separately, 206.2 liters of an aqueous solution (pH 4.0) containing 40.4 kg of silver nitrate was prepared and kept at 10° C. A reaction vessel in which 635 liters of distilled water and 30 liters of tert-butyl alcohol were placed was kept at 30° C. with thorough stirring, and thereto the total amount of the sodium behenate solution B and the total amount of the aqueous solution of silver nitrate was added at their individual constant flow rates over a period of 93 minutes and 15 seconds and a period of 90 minutes, respectively. During the procedure, only the aqueous solution of silver nitrate was added for 11 minutes from the beginning of the addition of aqueous solution of silver nitrate, then the addition of sodium behenate solution B was initiated. Only the sodium behenate solution B was added for 14 minutes and 15 seconds from the termination of addition of aqueous solution of silver nitrate. During the addition, the temperature in the reaction vessel was maintained at 30° C. by controlling ambient temperature so that the solution temperature was kept constant. A piping system for the addition of sodium behenate solution B was kept warm by circulating hot water through the outer pipe in a double pipe, and the solution temperature at the outlet of addition nozzle was adjusted at 75° C. A piping system for the addition of aqueous silver nitrate solution was kept at a constant temperature by circulating cold water through the outer piper in a double pipe. The outlet of addition nozzle for adding the sodium behenate solution B was added and that for adding the aqueous solution of silver nitrate were arranged symmetrically about the stirring axis and adjusted high enough not to come in contact with the reaction solution.

After the termination of addition of sodium behenate solution B, the mixture was allowed to stand at the same temperature with stirring for 20 minutes, then heated to a temperature of 35° C. over a period of 30 minutes, and ripened for 210 minutes. Immediately after the termination of ripening, the mixture was then subjected to centrifugal filtration to separate the solid content and the solid content was then rinsed until the conductivity of the filtrate reached 30 μS/cm. Thus, silver salt of fatty acid was obtained. The solid content thus obtained was then stored in the form of wet cake without drying.

The form of the silver behenate particles thus obtained was then evaluated by electron microphotography. As a result, the silver behenate was found to be a crystal having a side a of 0.21 μm, a side b of 0.4 μm and a side c of 0.4 μm, on average, an average aspect ratio of 2.1, and a variation coefficient of 11% with respect to the sphere equivalent diameter (wherein a, b and c have the same meaning as defined hereinbefore, respectively).

To the wet cake in an amount corresponding to 260 kg on a dry solid basis was added 19.3 kg of polyvinyl alcohol (PVA-217, trade name). To the mixture was added water to make 1,000 kg. The mixture was slurried by means of a dissolver blade. The mixture was subjected to previous dispersion using a pipeline mixer (Model PM-10, produced by Mizuho Industrial Co., Ltd.).

Subsequently, the preliminarily dispersed solution was processed three times by means of a dispersing machine (Microfluidizer M-610, trade name, produced by Microfluidex International Corporation wherein Z-type interaction chamber was used) under the pressure adjusted to $1.13\times10^8$ Pa (1,150 kg/cm$^2$), thereby preparing a silver behenate dispersion. The dispersion temperature was set at 18° C. by providing with spiral heat exchangers on the front and the rear of interaction chamber respectively and controlling the temperature of the coolant used therein.

(Preparation of Dispersion of Reducing Agent)

<Preparation of Dispersion of Reducing Agent Complex 1>

To 10 kg of Reducing Agent Complex 1 (1:1 complex of 6,6'-di-tert-butyl-4,4'-dimethyl-2,2'-butylidenediphenol and triphenylphosphine oxide), 0.12 kg of triphenylphosphine oxide and 16 kg of a 10 wt % aqueous solution of a modified polyvinyl alcohol (Poval MP203 produced by Kuraray CO., LTD.) was added 10 kg of water. The mixture was thoroughly stirred to obtain a slurry. The slurry was supplied by a diaphragm pump into a horizontal sandmill (UVM-2 produced by AIMEX Co., Ltd.) filled with zirconia beads having an average diameter of 0.5 mm where it was then dispersed for 4 hours and 30 minutes. To the dispersion were added 0.2 g of benzisothiazolinone sodium salt and water to make the reducing agent complex concentration 22 wt %, thereby obtaining a dispersion of Reducing Agent Complex 1. The reducing agent complex particles in the reducing agent complex dispersion thus obtained had a median diameter of 0.45 μm and a maximum particle diameter of not greater than 1.4 μm. The reducing agent complex dispersion thus obtained was filtered through a polypropylene filter having a pore diameter of 3.0 μm to remove foreign matters such as dust, and then stored.

<Preparation of Dispersion of Reducing Agent 2>

To 10 kg of Reducing Agent 2 (6,6'-di-tert-butyl-4,4'-dimethyl-2,2'-butylidenediphenol) and 16 kg of a 10 wt % aqueous solution of a modified polyvinyl alcohol (Poval MP203 produced by Kuraray CO., LTD.) was added 10 kg of water. The mixture was then thoroughly stirred to obtain a slurry. The slurry was supplied by a diaphragm pump into a horizontal sandmill (UVM-2 produced by AIMEX Co., Ltd.) filled with zirconia beads having an average diameter of 0.5 mm where it was then dispersed for 3 hours and 30 minutes. To the dispersion were added 0.2 g of benzisothiazolinone sodium salt and water to make the reducing agent concentration 25 wt %. The dispersion was subjected to heat treatment at 60° C. for S hours to obtain a dispersion of Reducing Agent 2. The reducing agent particles in the reducing agent dispersion thus obtained had a median diameter of 0.40 μm and a maximum particle diameter of not greater than 1.5 μm. The reducing agent dispersion thus obtained was filtered through a polypropylene filter having a pore diameter of 3.0 μm to remove foreign matters such as dust, and then stored.

(Preparation of Dispersion of Hydrogen Bond-Forming Compound 1)

To 10 kg of Hydrogen Bond-Forming Compound 1 (tri (4-tert-butylphenyl)phosphine oxide) and 16 kg of a 10 wt % aqueous solution of modified polyvinyl alcohol (Poval MP-203, produced by Kuraray Co., Ltd.) was added 10 kg of water and the mixture was thoroughly stirred to prepare a slurry. The slurry was supplied by means of a diaphragm pump into a horizontal sand mill (Model UVM-2 produced by AIMEX Co., Ltd.) filled with zirconia beads having an average diameter of 0.5 mm and underwent a dispersing operation over a period of 3 hours and 30 minutes, and further adjusted so as to have the hydrogen bond-forming compound concentration of 25 wt % by addition of 0.2 g of benzisothiazolinone sodium salt and water. The dispersion was heated at 80° C. for one hour to obtain a dispersion of Hydrogen Bond-Forming Compound-1 was obtained. The hydrogen bond-forming compound particles present in the thus prepared hydrogen bond-forming compound dispersion had a median diameter of 0.35 μm and a maximum diameter of not greater than 1.5 μm. The hydrogen bond-forming compound dispersion was filtered through a polypropylene filter having a pore diameter of 3.0 μm to remove foreign matters such as dust, and then stored.

(Preparation of Dispersion of Development Accelerator)

<Preparation of Dispersion of Development Accelerator 1>

To 10 kg of Development Accelerator 1 and 20 kg of a 10 wt % aqueous solution of modified polyvinyl alcohol (Poval MP-203 produced by Kuraray Co., Ltd.) was added 10 kg of water and the mixture was thoroughly stirred to prepare a slurry. The slurry was supplied by means of a diaphragm pump into a horizontal sand mill (Model UVM-2 produced by AIMEX Co., Ltd.) filled with zirconia beads having an average diameter of 0.5 mm and underwent a dispersing operation over a period of 3 hours and 30 minutes, and further adjusted so as to have the development accelerator concentration of 20 wt % by addition of 0.2 g of benzisothiazolinone sodium salt and water. Thus, a dispersion of Development Accelerator 1 was obtained. The development accelerator particles present in the thus prepared development accelerator dispersion had a median diameter of 0.48 μm and a maximum diameter of not greater than 1.4 μm. The dispersion was filtered through a polypropylene filter having a pore size of 3.0 μm to remove foreign matters such as dust, and then stored.

<Preparation of Dispersion of Development Accelerator 2 and Preparation of Dispersion of Toning Agent 1>

Dispersions of Development Accelerator 2 and Toning Agent 1 were prepared in the same manner as in Dispersion of Development Accelerator 1, respectively. The concentration of ingredient in each dispersion was 20 wt %.

(Preparation of Polyhalogen Compound Dispersion)

<Preparation of Dispersion of Organic Polyhalogen Compound 1>

To 10 kg of Organic Polyhalogen Compound 1 (tribromomethanesulfonylbenzene), 10 kg of a 20 wt % aqueous solution of modified polyvinyl alcohol (Poval MP-203 produced by Kuraray Co., Ltd.), 0.4 kg of a 20 wt % aqueous solution of sodium triisopropylnaphthalenesulfonate was added 14 kg of water and thoroughly mixed to prepare a slurry. The slurry was supplied by means of a diaphragm pump into a horizontal sand mill (UVM-2 produced by AIMEX Co., Ltd.) filled with zirconia beads having an average diameter of 0.5 mm, subjected to a dispersing operation over a period of 5 hours, and adjusted so as to have the organic polyhalogen compound concentration of 26 wt % by addition of 0.2 g of benzisothiazolinone sodium salt and water. Thus, a dispersion of Organic Polyhalogen Compound 1 was obtained. The organic polyhalogen compound particles present in the thus prepared organic polyhalogen compound dispersion had a median diameter of 0.41 μm and a maximum diameter of not grater than 2.0 μm. The dispersion was filtered through a polypropylene filter having a pore size of 10.0 μm to remove foreign matters such as dust, and then stored.

<Preparation of Dispersion of Organic Polyhalogen Compound 2>

To 10 kg of Organic Polyhalogen Compound 2 (N-butyl-3-tribromomethanesulfonylbenzamide) and 20 kg of a 10 wt % aqueous solution of modified polyvinyl alcohol (Poval MP-203 produced by Kuraray Co., Ltd.) was added 0.4 kg of a 20 wt % aqueous solution of sodium triisopropylnaphthalenesulfonate and thoroughly mixed to prepare a slurry. The slurry was supplied by means of a diaphragm pump into a horizontal sand mill (UVM-2 produced by AIMEX Co., Ltd.) filled with zirconia beads having an average diameter of 0.5 mm, subjected to a dispersing operation over a period of 5 hours, and further adjusted so as to have the organic polyhalogen compound concentration of 30 wt % by addition of 0.2 g of benzisothiazolinone sodium salt and water. The dispersion obtained was heated at 40° C. for 5 hours. Thus, a dispersion of Organic Polyhalogen Compound 2 was obtained. The organic polyhalogen compound particles present in the thus prepared organic polyhalogen compound dispersion had a median diameter of 0.40 μm and a maximum diameter of not greater than 1.3 μm. The dispersion was filtered through a polypropylene filter having a pore size of 3.0 μm to remove foreign matters such as dust, and then stored.

(Preparation of Solution of Phthalazine Compound 1)

In 174.57 kg of water, 8 kg of modified polyvinyl alcohol (Poval MP-203 produced by Kuraray Co., Ltd.) was dissolved. To the solution were added 3.15 kg of a 20 wt % aqueous solution of sodium triisopropylnaphthalenesulfonate and 14.28 kg of a 70 wt % aqueous solution of Phthalazine Compound 1 (6-isopropylphthalazine). Thus, a 5 wt % solution of Phtahalzine Compound 1 was prepared.

(Preparation of Solution of Mercapto Compound)

<Preparation of Aqueous Solution of Mercapto Compound 1>

In 993 g of water was dissolved 7 g of Mercapto Compound 1 (sodium salt of 1-(3-sulfophenyl)-5-mercaptotetrazole) to prepare a 0.7 wt % aqueous solution.

<Preparation of Aqueous Solution of Mercapto Compound 2>

In 980 g of water was dissolved 20 g of Mercapto Compound 2 (sodium salt of 1-(3-methylureidophenyl)-5-mercaptotetrazole) to prepare a 2.0 wt % aqueous solution.

(Preparation of Dispersion of Pigment 1)

To 64 g of C.I. Pigment Blue 60 and 6.4 g of Demol N produced by Kao Corp. was added 250 g of water, and the composition was thoroughly mixed to form a slurry. The slurry was put in a vessel together with 800 g of zirconia beads having an average diameter of 0.5 mm, dispersed for 25 hours by means of a dispersing machine (1/4G sand grinder mill produced by AIMEX Co., Ltd.), and then adjusted so as to have the pigment concentration of 5 wt % by addition of water, whereby a dispersion of Pigment 1 was prepared. The pigment particles in the pigment dispersion thus obtained had an average particle size of 0.21 μm.

<Preparation of SBR Latex>

A latex of SBR was prepared in the following manner.

In a polymerization vessel of a gas monomer reactor (TAS-2J Type, produced by Taiatu Glass Kogyo Co., Ltd.) were charged 287 g of water, 7.73 g of a surfactant (Pionin A-43-S, produced by Takemoto Oil and Fat Co., Ltd.; solid content: 48.5%), 14.06 ml of an aqueous sodium hydroxide solution having a concentration of 1 mol/liter, 0.15 g of tetrasodium ethylenediaminetetraacetate, 255 g of styrene, 11.25 g of acrylic acid and 3.0 g of tert-dodecylmercaptan. The reactor was sealed and agitated at a agitation speed of 200 rpm. After repetition of a few times of deaeration by a vacuum pump and substitution with nitrogen gas, 108.75 g of 1,3-butadiene was injected and an inner temperature was elevated to 60° C. Then, a solution prepared by dissolving 1.875 g of ammonium persulfate in 50 ml of water was added to the reaction mixture, followed by agitating for 5 hours. The inner temperature was elevated to 90° C., followed by agitating for 3 hours. After the completion of the reaction, the inner temperature was lowered to room temperature, and reaction mixture was treated with an aqueous solution of NaOH having a concentration of 1 mol/liter and an aqueous solution of $NH_4OH$ having a concentration of 1 mol/liter so as to have a ratio of $Na^+$ ion/$NH_4$+ ion of 1/5.3 by mole, thereby adjusting pH at 8.4. The mixture was passed through a polypropylene filter having a pore size of 1.0 μm to eliminate extraneous matter including dust, and then stored. Thus, 774.7 g of SBR latex was obtained. As a result of the measurement of halogen ion concentration by ion chromatography, it was found that a chloride ion concentration was 3 ppm. A concentration of the chelating agent measured by high speed liquid chromatography was 145 ppm.

The resulting latex has an average particle size of 90 nm, a Tg of 17° C., a solid content of 44 wt %, an equilibrium moisture content of 0.6 wt % at 25° C. and 60% RH, an ionic conductivity of undiluted latex (44 wt %) of 4.80 mS/cm (measured at 25° C. with a conductometer CM-30S produced by DKK-TOA Corp.), and pH of 8.4.

SBR latices having different Tg values can be prepared in a similar manner described above by appropriately varying the ratio of styrene to butadiene.

(Preparation of Coating Composition)

<Preparation of Coating Composition-1 for Emulsion Layer (Light-Sensitive Layer)>

To 1,000 g of the dispersion A of Fatty Acid Silver Salt were added successively 276 ml of water, 33 g of the dispersion of Pigment 1, 21 g of the dispersion of Organic Polyhalogen Compound 1, 58 g of the dispersion of Organic Polyhalogen Compound 2, 173 g of the solution of Phthalazine Compound 1, 1,082 g of the SBR latex (Tg: 17° C.), 299 g of the dispersion of Reducing Agent Complex 1, 5.7 g of the dispersion of Development Accelerator 1, 9 ml of the aqueous solution of Mercapto Compound 1 and 27 ml of the aqueous solution of Mercapto Compound 2. To the mixture, 117 g of the silver halide mixed Emulsion A was added just before coating, followed by mixing thoroughly. The coating composition for emulsion layer thus prepared was fed as it was into a coating die to conduct coating operation.

The viscosity of the coating composition was 25 mpa·s measured at 40° C. (No. 1 rotor, 60 rpm) with a Brookfield type viscometer produced by Tokyo Keiki Kogyo.

Further, the coating composition had viscosity values of 230, 60, 46, 24 and 18 mPa·s measured at 25° C. under shear rates of 0.1, 1, 10, 100 and 1,000 $s^{-1}$, respectively, by means of RFS Fluid Spectrometer produced by Rheometrics Far-east Co., Ltd.

The content of zirconium in the coating composition was 0.38 mg per g of silver.

<Preparation of Coating Composition for Interlayer on Emulsion Side>

The coating composition for interlayer was prepared by mixing 1,000 g of polyvinyl alcohol (PVA-205 produced by Kuraray Co., Ltd.), 272 g of the dispersion of Pigment 1, 4,200 ml of a 19 wt % latex of methyl methacrylate/styrene/butyl acrylate/hydroxyethyl methacrylate/acrylic acid copolymer (copolymerization ratio: 64/9/20/5/2 by weight), 27 ml of a 5 wt % aqueous solution of Aerosol OT (produced by American Cyanamid Co.) and 135 ml of a 20 wt % aqueous solution of diammonium phthalate, adding thereto water in an amount to make the total amount 10,000 g, and adjusting the pH to 7.5 with NaOH. The composition thus prepared was fed into a coating die to attain a coverage of 9.1 ml/$m^2$.

The viscosity of the coating composition was 58 mPa·s at 40° C. (No.1 rotor, 60 rpm) measured with the Brookfield type viscometer.

<Preparation of Coating Composition for First Protective Layer on Emulsion Side>

Inert gelatin in an amount of 64 g was dissolved in water, and thereto were added 112 g of a 19.0 wt % latex of methyl methacrylate/styrene/butyl acrylate/hydroxyethyl methacrylate/acrylic acid copolymer (copolymerization ratio: 64/9/20/5/2 by weight), 30 ml of a 15 wt % methanol solution of phthalic acid, 23 ml of a 10 wt % aqueous solution of 4-methylphthalic acid, 28 ml of diluted sulfuric acid having a concentration of 0.5 mol/liter, 5 ml of a 5 wt % aqueous solution of Aerosol OT (American Cyanamid Co.), 0.5 g of phenoxyethanol and 0.1 g of benzisothiazolinone. Further, water was added thereto in an amount to adjust the total weight of the resultant mixture to 750 g, thereby preparing a coating composition. The composition was mixed with 26 ml of a 4 wt % aqueous solution of chrome alum by means of a static mixer just before coating, and fed into a coating die to attain at coverage of 18.6 ml/m$^2$.

The viscosity of the coating composition was 20 mPa·s at 40° C. (No.1 rotor, 60 rpm) measured with the Brookfield type viscometer.

<Preparation of Coating Composition for Second Protective Layer on Emulsion Side>

Inert gelatin in an amount of 80 g was dissolved in water, and thereto were added 102 g of a 27.5 wt % latex of methyl methacrylate/styrene/butyl acrylate/hydroxyethyl methacrylate/acrylic acid copolymer (copolymerization ratio; 64/9/20/5/2 by weight), a fluorine-containing surfactant as shown in Table 1 below, 23 ml of a 5 wt % aqueous solution of Aerosol OT (American Cyanamid Co.), 4 g of fine particle of polymethyl methacrylate (average particle size: 0.7 m), 21 g of fine particle of polymethyl methacrylate (average particle size: 4.5 $\mu$m), 1.6 g of 4-methylphthalic acid, 4.8 g of phthalic acid, 44 ml of diluted sulfuric acid having a concentration of 0.5 mol/liter and 10 mg of benzisothiazolinone. Further, water was added thereto in an amount to adjust the total weight to 650 g and, just before coating, 445 ml of aqueous solution containing 4 wt % chrome alum and 0.67 wt % phthalic acid was mixed therewith by means of a static mixer, thereby preparing a coating composition for second surface protective layer on the emulsion side. The composition was fed into a coating die to attain at coverage of 8.3 ml/m$^2$.

The viscosity of the coating composition was 19 mpa·s at 40° C. (No.1 rotor, 60 rpm) measured with the Brookfield type viscometer.

(Production of Heat-Developable Photosensitive Material 1)

On the back side of the support provided with the undercoat layer, the coating composition for anti-halation layer and the coating composition for protective layer on back side were coated by a simultaneous double coating method so as to have a gelatin coverage of 0.44 g/m$^2$ for the anti-halation layer and a gelatin coverage of 1.7 g/m$^2$ for the protective layer on back side, and dried to prepare a back layer.

On the undercoat opposite to the back side, the coating composition for emulsion layer (Coating Composition-1), the coating composition for interlayer, the coating composition for first protective layer and the coating composition for second protective layer were simultaneously coated in this order using a slide beads coating method, thereby producing a heat-developable photosensitive material. The temperatures of the coating compositions for the emulsion layer and the interlayer were adjusted to 31° C., that of the first protective layer to 36° C., and that of the second protective layer to 37° C., respectively.

The coating coverage (g/m$^2$) of each ingredient in the emulsion layer is described below:

| | |
|---|---|
| Silver behenate | 5.58 |
| Pigment (C. I. Pigment Blue 60) | 0.036 |
| Polyhalogen Compound 1 | 0.12 |
| Polyhalogen Compound 2 | 0.37 |
| Phthalazine Compound 1 | 0.19 |
| SBR latex | 9.98 |
| Reducing Agent Complex 1 | 1.41 |
| Development Accelerator 1 | 0.025 |
| Mercapto Compound 1 | 0.002 |
| Mercapto Compound 2 | 0.012 |
| Silver halide (as silver) | 0.091 |

The coating and drying conditions were as follows:

The coating operation was carried out at a speed of 160 m/min, the clearance between the tip of the coating die and the support was set in the range of 0.10 to 0.30 mm, and a pressure of the vacuum chamber was controlled so as to be lower by 196 to 882 Pa than atmospheric pressure. Prior to the coating operation, static charge of the support was eliminated by ion wind.

In the chilling zone subsequent to the coating zone, the coated layers were chilled with wind having a dry-bulb temperature of 10 to 20° C. Thereafter, the heat-developable photosensitive material was conveyed under a contact-free condition, and dried with drying air having a dry-bulb temperature of 23 to 45° C. and a wet-bulb temperature of 15 to 21° C. in a helical non-contact dryer.

After the drying, the coated layers were subjected to moisture adjustment at 25° C. under humidity of 40 to 60% RH, and then heated up to 70 to 90° C., followed by cooling to 25° C.

The matting degree of the heat-developable photosensitive material thus produced was 550 seconds on the light-sensitive layer side and 130 seconds on the back side in terms of Bekk smoothness. The pH of the surface on the light-sensitive layer side measured was 6.0

The chemical structures of the compounds used in the example are illustrated below.

Spectral Sensititzing Dye A

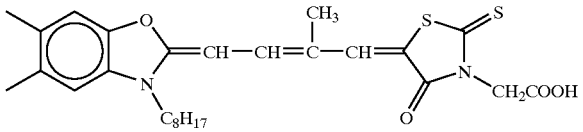

Spectral Sensitizing Dye B

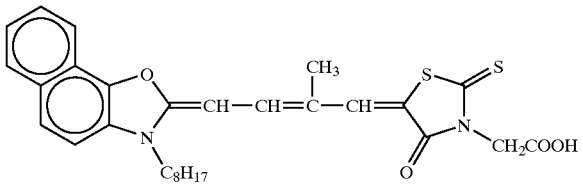

Tellurium Sensitizer C

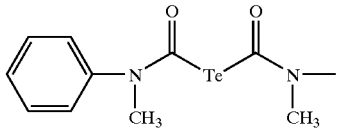

-continued
Base Precursor Compound 1
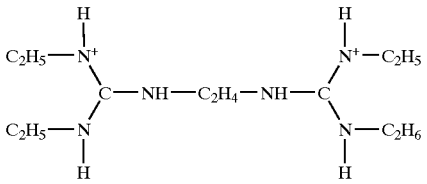
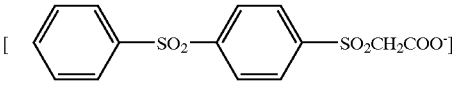
Cyanine Dye Compound 1
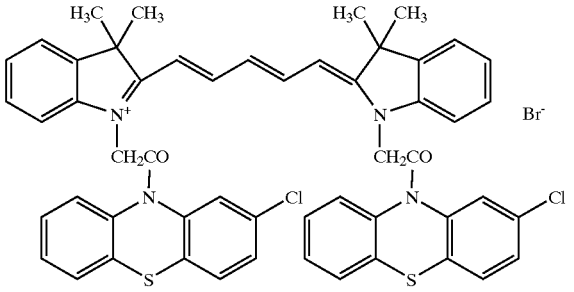
Blue Dye Compound 1
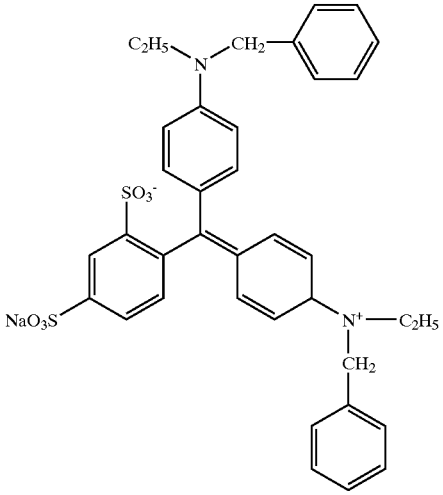
Yellow Dye Compound 1
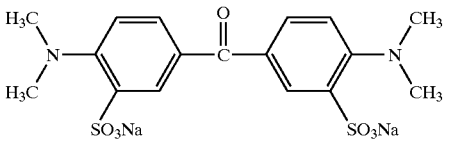
Reducing Agent Complex 1
1:1 Complex of
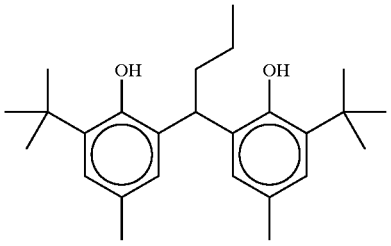
and
-continued
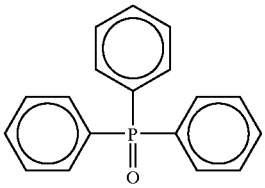
Reducing Agent 2
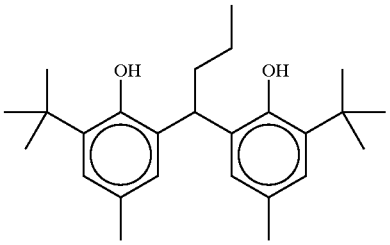
Hydrogen Bond-Forming Compound 1
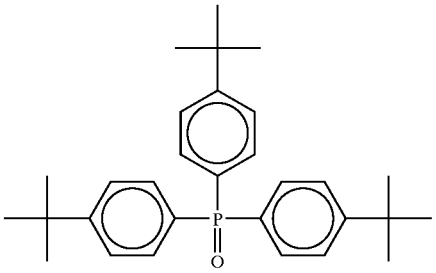
Polyhalogen Compound 1
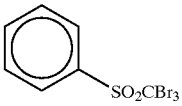
Polyhalogen Compound 2
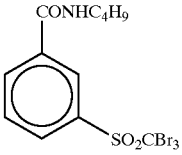
Mercapto Compound 1
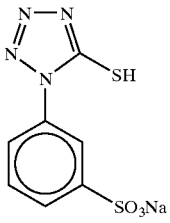
Mercapto Compound 2
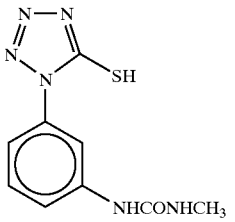
Phthalazine Compound 1
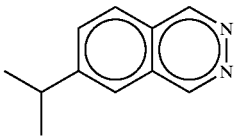

-continued

Development Accelerator 1

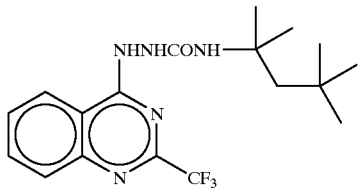

Development Accelerator 2

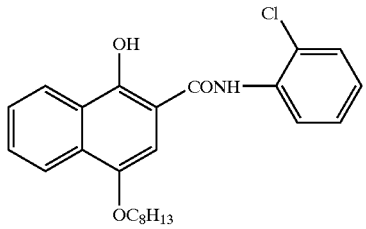

Toning Agent

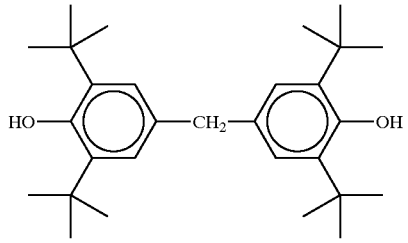

(Production of Heat-Developable Photosensitive Materials 2 to 10)

Heat-developable photosensitive materials 2 to 6 were produced in the same manner as Heat-developable photosensitive material 1, except that the fluorine-containing surfactant in the coating composition for protective layer on the light-sensitive layer side and the fluorine-containing surfactant in the coating composition for protective layer on the back side were changed as shown in Table 1 below respectively. Similarly, Heat-developable photosensitive materials 7 to 10 were produced by changing the coating coverage of $SnO_2$/SbO in the undercoat layer so as to change the cross section resistance as shown in Table 1 below respectively.

(Packaging of Heat-Developable Photosensitive Material)

Each heat-developable photosensitive material thus obtained was cut into sheets measuring 356 mm by 432 mm, made to a stack of 101 sheets, wrapped in a packaging material described below in surroundings of 25° C. and 50% RH, stored at ambient temperature for 2 weeks, and then subjected to the evaluations described below.

(Packaging Material)

A laminate of 10 μm-thick PET, 12 μm-thick PE, 9 μm-thick aluminum foil, 15 μm-thick Ny and 50 μm-thick polyethylene containing 3% carbon black (oxygen permeability: $2.28\times10^{-8}$ ml/Pa·m$^2$·s (at 25° C.) (0.02 ml/atm·m$^2$·25° C.·day); moisture permeability: $1.14\times10^{-7}$ g/Pa·m$^2$·s (at 25° C.) (0.10 g/atm·m$^2$·25° C.·day)

(Evaluation of Photographic Properties)

A heat-developing machine of three-tray type according to a preferred embodiment of the invention as shown in FIG. 1, which has 3 panel heaters for heat-development and is similar to Fuji Medical Dry Laser Imager FM-DP L (equipped with 660 nm semiconductor laser having output of 60 mW (IIIB) at the maximum) was used for experiment. The heights of 3 trays above the floor were 32 cm, 50 cm and 68 cm, respectively. Taking the stack of heat-developable photosensitive materials in and out was repeated 20 times with each of the 3 trays. Then, the heat-developable photosensitive material was exposed and heat-developed with 3 panel heaters set at 112° C., 121° C. and 121° C., respectively, under conditions that the total heat-development time was adjusted to 24 seconds through automatic conveyance. Combinations of the heat-developable photosensitive material and the tray are shown in Table 1 below. The exposure was conducted so as to form a uniform image having a density of 1.2. The surface qualities of heat-developable photosensitive material were evaluated in the following manner.

(Evaluation of White Spot at Exposure)

White spot formed at the exposure caused by extraneous matter present on the light-sensitive layer surface was evaluated according to the following criteria:

A: Number of white spots is 1 or less per sheet of heat-developable photosensitive material measuring 356 mm by 432 mm, and preferable.

B: Although 1 to 5 white spots per sheet are present, they have small sizes, and allowable.

C: Number of white spots is 10 or less per sheet, but those having large sizes are recognized, and at the edge of allowance.

D: Large numbers of white spots having large sizes are recognized, and not acceptable.

(Evaluation of Development Unevenness at Heat Development)

Development unevenness formed at the heat development caused by extraneous matter present on the back layer surface was evaluated according to the following criteria:

A: Development unevenness is not observed at all, and preferable.

B: Development unevenness is slightly observed on uniform density image, but it is not recognized on practical diagnosis image, and allowable.

C: Development unevenness is in a level recognized on diagnosis image, and not acceptable.

TABLE 1

| Experiment No. | Heat-Developable Photosensitive Material | Height of Tray above Floor (cm) | Fluorine Compound | Cross Section Resistance (logoΩ/□) | White Spot at Exposure | Development Unevenness at Heat Development | Remarks |
|---|---|---|---|---|---|---|---|
| 1 | 1 | 68 | Comparative Compound 1 (2.5 mg/m$^2$) | 11.0 | B | B | — |
| 2 | 2 | 68 | Comparative Compound 2 (5 mg/m$^2$) | 11.0 | B | B | — |

TABLE 1-continued

| Experiment No. | Heat-Developable Photosensitive Material | Height of Tray above Floor (cm) | Fluorine Compound | Cross Section Resistance (logoΩ/□) | White Spot at Exposure | Development Unevenness at Heat Development | Remarks |
|---|---|---|---|---|---|---|---|
| 3 | 1 | 50 | Comparative Compound 1 (2.5 mg/m$^2$) | 11.0 | D | C | Comparison |
| 4 | 2 | 50 | Comparative Compound 2 (5 mg/m$^2$) | 11.0 | C | C | Comparison |
| 5 | 3 | 50 | Comparative Compound 3 (3 mg/m$^2$) | 11.0 | D | C | Comparison |
| 6 | 4 | 50 | F-29 (1 mg/m$^2$) | 11.0 | C | B | Invention |
| 7 | 5 | 50 | F-17 (1 mg/m$^2$) | 11.0 | C | B | Invention |
| 8 | 6 | 50 | F-25 (2.5 mg/m$^2$) | 11.0 | C | B | Invention |
| 9 | 7 | 50 | Comparative Compound 3 (3 mg/m$^2$) | 9.5 | D | C | Comparison |
| 10 | 8 | 50 | F-29 (1 mg/m$^2$) | 9.5 | B | A | Invention |
| 11 | 9 | 50 | F-17 (1 mg/m$^2$) | 9.5 | A | A | Invention |
| 12 | 10 | 50 | F-25 (2.5 mg/m$^2$) | 9.5 | B | A | Invention |
| 13 | 3 | 32 | Comparative Compound 3 (3 mg/m$^2$) | 11.0 | D | C | Comparison |
| 14 | 4 | 32 | F-29 (1 mg/m$^2$) | 11.0 | C | B | Invention |
| 15 | 8 | 32 | F-29 (1 mg/m$^2$) | 9.5 | B | B | Invention |
| 16 | 9 | 32 | F-17 (1 mg/m$^2$) | 9.5 | A | B | Invention |

Comparative Compound 1

$$CF_3(CF_2)_nCH_2CH_2SCH_2CH_2COOLi$$

Mixture of n=7 to 11

Comparative Compound 2

$$CF_3\ (CF_2)_nCH_2CH_2O(CH_2CH_2O)_mH$$

Mixture of n=7 to 11 and m=5 to 15

Comparative Compound 3

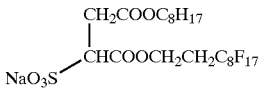

From the results shown in Table 1, it can be seen that the white spot at the exposure and the white spot at the heat development, which especially occur when heat-developable photosensitive materials are placed near the floor, are remarkably prevented by the use of specific fluorine compound according to the invention. In particular, the outstanding effects on the white spot at the heat development are recognized.

Example 2

Heat-developable photosensitive material 101 was produced in the same manner as in Heat-developable photosensitive material 1 of Example 1 except for the following modifications.

<Preparation of Coating Composition 101 for Emulsion Layer (Light-Sensitive Layer)>To 1,000 g of the Dispersion B of Fatty Acid Silver Salt were added successively 276 ml of water, 35 g of the dispersion of Pigment 1, 32 g of the dispersion of Organic Polyhalogen compound 1, 46 g of the dispersion of Organic Polyhalogen Compound 2, 173 g of the solution of Phthalazine Compound 1, 1,082 g of the SBR latex (Tg: 17° C.), 153 g of the dispersion of Reducing Agent 2, 55 g of the dispersion of Hydrogen Bond-Forming Compound 1, 4.8 g of the dispersion of Development Accelerator 1, 5.2 g of the dispersion of Development Accelerator 2, 2.1 g of the dispersion of Toning Agent 1 and 8 μl of the aqueous solution of Mercapto Compound 2. To the mixture, 140 g of the silver halide mixed Emulsion A was added just before coating, followed by mixing thoroughly. The coating composition for emulsion layer thus prepared was fed as it was into a coating die to conduct coating operation.

The viscosity of the coating composition was 40 mPa·s as measured at 40° C. (No.1 rotor, 60 rpm) with a Brookfield type viscometer produced by Tokyo Keiki Kogyo.

Further, the coating composition had viscosity values of 530, 144, 96, 51 and 28 mPa·s as measured at 25° C. under shear rates of 0.1, 1, 10, 100 and 1,000 s$^{-1}$, respectively, by means of RFS Fluid Spectrometer produced by Rheometrics Fareast Co. Ltd.

The content of zirconium in the coating composition was 0.25 mg per g of silver.

<Production of Heat-Developable Photosensitive Material 101)

Heat-developable photosensitive material 101 was produced in the same manner as Heat-developable photosensitive material 4 except that Coating Composition-1 was changed to Coating Composition-101 for Emulsion Layer and that Yellow Dye Compound 1 was eliminated from the coating composition for anti-halation layer.

The coating coverage (g/m$^2$) of each ingredient in the emulsion layer is described below:

| | |
|---|---|
| Silver behenate | 5.27 |
| Pigment (C. I. Pigment Blue 60) | 0.036 |
| Polyhalogen Compound 1 | 0.17 |
| Polyhalogen Compound 2 | 0.28 |
| Phthalazine Compound 1 | 0.18 |
| SBR latex | 9.43 |
| Reducing Agent 2 | 0.77 |
| Hydrogen Bond-Forming Compound 1 | 0.28 |
| Development Accelerator 1 | 0.019 |
| Development Accelerator 2 | 0.020 |
| Toning Agent 1 | 0.008 |
| Mercapto Compound 2 | 0.003 |
| Silver halide (as silver) | 0.091 |

Heat-developable photosensitive materials 102 to 106 were produced in the same manner as Heat-developable photosensitive materials 5, 6, 8, 9 and 10 except that Coating Composition-1 was changed to Coating Composition-101 for Emulsion Layer and that Yellow Dye Compound 1 was eliminated from the coating composition for anti-halation layer, respectively.

Each heat-developable photosensitive material was evaluated in the same manner as in Example 1 except for shortening the heat-development time from 24 seconds to 14 seconds. The conveyance speed of heat-developable photosensitive material was 28.6 mm/sec. Heat-developable photosensitive materials 101 to 106 containing the fluorine compound according to the invention provide the same preferred results with respect to the white spot at the exposure and the white spot at the heat-development as in Example 1.

The heat-developable photosensitive material according to the present invention having a protective layer containing a fluorine compound having at least one fluorinated alkyl group having not less than 2 carbon atoms and not more than 13 fluorine atoms and at least one anionic or nonionic hydrophilic group can prevent image defects such as white spots on the image formed by the heat development resulting from adhesion of dust and satisfactory image quality is maintained, even when it is processed in a heat-developing machine having a stock tray for heat-developable photosensitive material provided on the position close to the floor, Therefore, a processing while maintaining high image quality without the occurrence of image defects such as white spots can be performed according to the processing method using the heat-developable photosensitive material and the heat-developing machine as described above.

The entire disclosure of each and every foreign patent application from which the benefit of foreign priority has been claimed in the present application is incorporated herein by reference, as if fully set forth herein.

While the invention has been described in detail and with reference to specific examples thereof, it will be apparent to one skilled in the art that various changes and modifications can be made therein without departing from the spirit and scope thereof.

What is claimed is:

1. A method of processing a heat-developable photosensitive material comprising imagewise exposing and heat develonina the heat-developable material in a heat-developing machine having at least three stock trays for heat-developable photosensitive materials placed at a height of not more than 55 cm above a floor, wherein said heat-developable material comprises a light-sensitive layer containing a light-sensitive silver halide, a light-insensitive organic silver salt, a thermal developer and a binder and a protective layer containing a fluorine compound having at least one fluorinated alkyl group having not less than 2 carbon atoms and not more than 13 fluorine atoms and at least one anionic or nonionic hydrophilic group.

2. The method of processing a heat-developable photosensitive material as claimed in claim 1, wherein the heat-developing machine has an exposure section for the heat-developable photosensitive material arranged above the stock tray for heat-developable photosensitive materials.

3. The method of processing a heat-developable photosensitive material as claimed in claim 1, wherein the fluorine compound is a compound represented by the following formula (F):

(F)

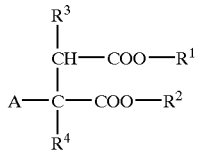

wherein, $R^1$ and $R^2$ each represents a substituted or unsubstituted alkyl group, provided that at least one of $R^1$ and $R^2$ represents a fluorinated alkyl group having not less than 2 carbon atoms and not more than 13 fluorine atoms; $R^3$ and $R^4$ each represents a hydrogen atom or a substituted or unsubstituted alkyl group; A represents —Lb—$SO_3M$; M represents a hydrogen atom, a metallic atom or an ammonium group; and Lb represents a single bond or a substituted or unsubstituted alkylene group.

4. The method of processing a heat-developable photosensitive material as claimed in claim 3, wherein both $R^3$ and $R^4$ in the compound represented by formula (F) represent hydrogen atoms.

5. The method of processing a heat-developable photosensitive material as claimed in claim 3, wherein Lb in the compound represented by formula (F) represents a —$CH_2$— group.

6. The method of processing a heat-developable photosensitive material as claimed in claim 3, wherein at least one of $R^1$ and $R^2$ in the compound represented by formula (F) represents a fluorinated alkyl group having not less than 4 carbon atoms and not more than 11 fluorine atoms.

7. The method of processing a heat-developable photosensitive material as claimed in claim 3, wherein $R^1$ and $R^2$ in the compound represented by formula (F) each represents a fluorinated alkyl group having not less than 4 carbon atoms and not more than 11 fluorine atoms.

* * * * *